US010792835B2

(12) United States Patent
Kilpela et al.

(10) Patent No.: US 10,792,835 B2
(45) Date of Patent: Oct. 6, 2020

(54) KINDLING SPLITTER APPARATUS AND METHODS OF USE

(71) Applicant: Marquette Solutions LLC, Marquette, MI (US)

(72) Inventors: Thomas Kilpela, Marquette, MI (US); Brian Patrick Janowski, Marquette, MI (US); Robert A. Goodwin, Jr., Marquette, MI (US); Joseph David Mohar, Marquette, MI (US)

( * ) Notice: Subject to any disclaimer, the term of this patent is extended or adjusted under 35 U.S.C. 154(b) by 268 days.

(21) Appl. No.: 15/872,960

(22) Filed: Jan. 16, 2018

(65) Prior Publication Data

US 2018/0200919 A1 Jul. 19, 2018

Related U.S. Application Data

(60) Provisional application No. 62/446,594, filed on Jan. 16, 2017.

(51) Int. Cl.
*B27L 7/06* (2006.01)
*B27L 7/00* (2006.01)

(52) U.S. Cl.
CPC ..... *B27L 7/06* (2013.01); *B27L 7/005* (2013.01)

(58) Field of Classification Search
CPC .... B27L 7/00; B27L 7/005; B27L 7/06; B27L 7/08
See application file for complete search history.

(56) References Cited

U.S. PATENT DOCUMENTS

| | | | |
|---|---|---|---|
| 1,830,769 | A | 11/1931 | Edgar |
| 2,203,632 | A | 6/1940 | Munson et al. |
| 2,646,955 | A | 7/1953 | Russell |

(Continued)

FOREIGN PATENT DOCUMENTS

| | | | |
|---|---|---|---|
| DE | 3100044 | A1 | 2/1982 |
| DE | 102008016470 | A1 | 10/2009 |
| WO | 2012069801 | A1 | 5/2012 |

OTHER PUBLICATIONS

DutchCrafters, Amish Tilt Out Trash Bin Cabinet with Drawer, Screenshot at 0:15, "https://www.youtube.com/watch?v=VDRRYuxxSh4" (Year: 2012).*

(Continued)

*Primary Examiner* — Adam J Eiseman
*Assistant Examiner* — Fred C Hammers
(74) *Attorney, Agent, or Firm* — Device Patent LLC

(57) ABSTRACT

A wood splitter apparatus comprising a base portion and a leg portion extending upwards from the base portion. An elevated cross member portion extending across the leg portion. A blade portion extending superiorly from the cross member portion. A leading upward edge at a superior aspect of the blade portion for splitting wood. A first splitter surface angled from a second splitter surface inferior to the leading upward edge. A collector portion positioned below the blade portion where the collector portion has a capture space. The collector having a floor face at a bottom of said capture space. The collector portion supported at an angle such that the floor face is sloped defining a high side and a low side where kindling split from a log over the blade portion falls into the high side of the collector portion and gathers on the low side of the collector portion.

20 Claims, 20 Drawing Sheets

(56) References Cited

U.S. PATENT DOCUMENTS

| | | | | |
|---|---|---|---|---|
| 2,851,072 | A | 9/1958 | Gerjets et al. | |
| 3,026,865 | A | 3/1962 | Kazuichi | |
| 3,100,481 | A | 8/1963 | Stefanick | |
| 3,242,955 | A | 3/1966 | Hellstrom | |
| 3,802,473 | A | 4/1974 | Carr | |
| 3,886,927 | A | 6/1975 | Chattin | |
| 3,924,501 | A | 12/1975 | Cohen et al. | |
| 4,239,198 | A | 12/1980 | Trupp | |
| 4,244,407 | A | 1/1981 | McMullin | |
| 4,315,534 | A | 2/1982 | Blackstone | |
| 4,341,246 | A | 7/1982 | Salladay | |
| 4,362,194 | A | 12/1982 | Lawson | |
| 4,378,037 | A | 3/1983 | Conn | |
| 4,391,311 | A * | 6/1983 | Levercom | B27L 7/00 144/193 D |
| 4,411,298 | A | 10/1983 | Ellingsen et al. | |
| 4,431,040 | A | 2/1984 | Friedrich et al. | |
| 4,446,898 | A | 5/1984 | Manteufel | |
| 4,453,580 | A | 6/1984 | Patten | |
| 4,782,867 | A | 11/1988 | Forsyth | |
| 4,782,868 | A | 11/1988 | Coller et al. | |
| 4,782,870 | A | 11/1988 | Duerr | |
| 4,800,937 | A | 1/1989 | Mangus | |
| 4,945,960 | A | 8/1990 | McCauley | |
| 5,245,902 | A | 9/1993 | Pereira | |
| 5,284,193 | A | 2/1994 | Mires et al. | |
| 5,520,105 | A | 5/1996 | Healy | |
| 5,575,319 | A | 11/1996 | Chick | |
| 6,112,784 | A | 9/2000 | Lough | |
| 6,390,162 | B1 | 5/2002 | Sahlem | |
| 6,453,958 | B1 | 9/2002 | Slavich | |
| 6,568,577 | B2 | 5/2003 | Baird et al. | |
| 6,601,746 | B2 | 8/2003 | Buckley et al. | |
| 6,763,864 | B2 | 7/2004 | Setlack et al. | |
| 6,886,551 | B2 | 5/2005 | Scherer et al. | |
| 7,096,901 | B2 | 8/2006 | Brazzola | |
| 7,107,982 | B1 | 9/2006 | Lechner | |
| 7,243,826 | B2 | 7/2007 | Darst | |
| 7,441,760 | B2 * | 10/2008 | Zhang | B25B 1/02 269/139 |
| 7,556,072 | B2 | 7/2009 | Koch | |
| 7,587,968 | B1 | 9/2009 | Roberts | |
| 7,756,072 | B1 | 7/2010 | Fenner et al. | |
| 7,913,726 | B1 | 3/2011 | Honnell | |
| 8,668,000 | B2 | 3/2014 | Carrillo | |
| 8,689,778 | B1 | 4/2014 | Flores | |
| 2008/0073361 | A1 | 3/2008 | Brouard | |
| 2009/0229709 | A1 | 9/2009 | Babcock | |
| 2016/0107330 | A1 | 4/2016 | Hutchinson et al. | |

OTHER PUBLICATIONS

DutchCrafters, Amish Pine Tilt Out Trash Bin Cabinet with One Drawer, https://www.dutchcrafters.com/Amish-Tilt-Out-Trash-Bin-Cabinet/p/2446 (Year: 2020).*

DutchCrafters, Amish Tilt Out Trash Bin Cabinet with Drawer, Screenshot at 0:05, "https://www.youtube.com/watch?v=VDRRYuxxSh4" (Year: 2012).*

Kindling Cracker King. From internet.

Mr. Quicksplit. Internet sourced.

* cited by examiner

KINDLING SPLITTER APPARATUS AND METHODS OF USE

This application claims priority to Provisional Patent Application No. 62/446,594 filed Jan. 16, 2017, the entire disclosure of which is hereby incorporated by reference and relied upon.

BACKGROUND OF THE INVENTION

Field of the Invention

The invention relates generally to apparatuses and methods of use for the splitting of wood, and more particularly to apparatuses and methods of use for the splitting of logs into kindling and mechanisms for eased gathering and transport of the kindling produced.

SUMMARY OF THE INVENTION

According to various forms of the invention, a wood splitter for making kindling and for eased gathering and transport, and methods of use are disclosed herein.

In one form, a wood splitter comprises a base portion, a leg portion, a cross member portion, a blade portion, a guide portion, a collector portion, and a collector retainer portion.

In one form, a wood splitter may be used to split a variety of types of wood including but not limited to logs, branches, and lumber.

In one form, a base portion is formed of a broad plate member.

In one form, a base portion is formed of individual pods.

In one form, a base portion is formed of a pair of spaced foot members.

In one form, the broad plate member is generally U-shaped.

In one form, the broad plate member is generally H-shaped.

In one form, the broad plate member is generally circular or polygonal.

In one form, the broad plate member comprises one or more base fastener holes extending between a top surface to a bottom surface on the broad plate member.

In one form, the broad plate member is formed from a plate of steel.

In one form, one or more of the base fastening holes includes a chamfered edge extending from a top surface towards the bottom surface.

In one form, a base portion comprises one or more lifts extending from it for angling a collector portion.

In one form, a broad plate member comprises one or more lifts extending from a broad plate member for angling a collector portion.

In one form, the one or more lifts extend from a top surface of a base portion.

In one form, the one or more lifts are in the form of generally vertical plates.

In one form, the one or more lifts comprise a lift wall for angular support of a collector portion.

In one form, the one or more lifts are positioned under an inferior end of a collector portion.

In one form, a leg portion extends superiorly from a base portion.

In one form, at least a portion of the leg portion is angled from vertical as it extends superiorly from a base portion.

In one form, a leg portion is fixed to the base portion.

In one form, a leg portion is fixed to the base portion using a weld or fasteners.

In one form, a leg portion is removably fixed to the base portion.

In one form, a leg portion comprises a first leg strut and a second leg strut spaced from said first leg strut.

In one form, a lift extends between a first leg strut and a second leg strut.

In one form, a lift is in the form of a generally horizontal bar or tube.

In one form, a gusset extends between a first leg strut and a base portion for increasing rigidity and strength of the first leg strut.

In one form, a gusset extends between a second leg strut and a base portion for increasing rigidity and strength of the second leg strut.

In one form, a first leg strut and a second leg strut are sufficiently spaced to place a wood log therebetween.

In one form, the first leg strut comprises a vertical segment, an angled segment, and a guide segment.

In one form, the vertical segment comprises a first leg end and a second leg end.

In one form, the vertical segment extends to an angled segment.

In one form, an angled segment extends to a guide segment.

In one form, a guide segment extends between a first leg strut and a second leg strut.

In one form, a first leg strut, a guide portion, and a second leg strut are formed from a single piece of metal.

In one form, said single piece of metal used to form the first leg strut and second leg strut is a bar or tube.

In one form, a cross member portion extends between the first leg strut and the second leg strut.

In one form, a first end and a second end of the cross member portion are welded respectively to a first outer surface of a first leg strut and a second outer surface of a second leg strut.

In one form, the cross member portion is in the form of an elongate bar or tube.

In one form, the cross member portion has a cross-sectional profile that is square or rectangular.

In one form, a blade portion is supported by said cross member portion.

In one form, a blade portion is positioned at an ergonomically beneficial height from the ground to prevent undue bending by a user when splitting a log. In one embodiment this height is 20 inches but may vary generally between 16 and 24 inches. This height also facilitates the splitting of longer logs.

In one form, a blade portion comprises a leading upward edge for cutting and splitting through wood.

In one form, an upwardly directed blade portion is angled from vertical to mirror ergonomic swing angle of a user.

In one form, a leading upward edge of a blade portion is straight, concave, or convex.

In one form, a blade portion is bimodal having a thin leading edge in a first phase and a wide wedge portion to fully separate a kindling piece form a log in a second phase.

In one form, the leading upward edge is a single linear edge. In other forms, the leading upward edge comprises intersecting linear edges forming a T shape wherein at each impact cycle two pieces of kindling are formed.

In one form, the blade portion comprises a first splitter wall with a first splitter surface thereon and a second splitter wall with a second splitter surface thereon.

In one form, a first splitter surface and second splitter surface are angled to cause the splitting of wood as a log is advanced down over a blade portion.

In one form, a blade portion comprises a first side face and an opposing second side face at lateral ends of the blade portion.

In one form, a blade portion comprises an entry channel with opposed first and second entry faces thereon.

In one form, a blade portion comprises a cross channel for seating of said cross member.

In one form, the cross channel comprises opposed first and second cross channel faces.

In one form, a force face extends between the first and second cross channel faces for counteracting impact forces induced by a user.

In one form, a guide portion comprises the guide segment and a guide plate extending from the guide segment.

In one form, a guide plate is removable from the guide segment by releasable interlocking with a portion of the guide segment.

In one form, a guide plate is fixed to the guide segment.

In one form, a guide plate is fixed to the guide segment using welds or fasteners.

In one form, a guide plate comprises a guide face to provide counter acting normal forces to a guide spacer or a log or a guide spacer and a log during a splitting operation.

In one form, a guide plate comprises a mount face opposing said guide segment.

In one form, a guide plate comprises a back face.

In one form, a guide face of a guide plate is generally parallel to a first splitter wall.

In one form, a guide face of a guide plate is generally parallel to an angled segment of a leg portion.

In one form, a guide plate is in the form of a wire, tube or bar.

In one form, a guide spacer resides against the guide plate facing a blade portion.

In one form, a guide spacer is in the form of a block of wood.

In one form, a guide spacer varies in thickness.

In one form, a guide spacer resides against a guide face of the guide segment.

In one form, a guide plate is spaced from the blade portion sufficient to pass a split piece of kindling wood therebetween.

In one form, a guide plate is variably distanced from a leading upward edge of a blade portion to split various thicknesses of kindling.

In one form, a guide spacer thickness and the guide plate position cooperate to provide a predetermined split thickness of kindling.

In one form, a guide portion provides for consistent kindling width, efficient use of material by maximizing the number of pieces split from a log, and increasing splitting speed and overall production by eliminating log positioning adjustments on a blade portion.

In one form, a collector comprises a capture space for collecting kindling parts.

In one form, a collector is positioned to collect kindling parts falling from a blade portion after splitting a log.

In one form, a collector is in the form of a bucket.

In one form, the bucket is generally cylindrical.

In one form, the bucket is of a standard five gallon variety available at popular hardware stores.

In one form, the bucket comprises a handle.

In one form, a bucket comprises a handle wherein the handle is formed of a bent metal rod.

In one form, a bucket comprises an exterior.

In one form, opposing ends of a bucket handle are pivotably attached to an exterior at a superior end of a collector.

In one form, a capture space is defined by one or more side walls.

In one form, the one or more side walls are generally upstanding.

In one form, the one or more side walls has an inside surface.

In one form, a capture space is defined by a floor wherein the floor comprises a floor face.

In one form, an inside surface intersects a floor face of a collector.

In one form, a collector comprises a top face at a superior end.

In one form, a collector comprises a rest face at an inferior end.

In one form, a collector retainer portion extends inferiorly below a blade portion.

In one form, a collector retainer portion is in the form of one or more fingers.

In one form, a collector retainer portion is in the form of a first spaced finger and a second spaced finger.

In one form, a collector portion is removably retained under a blade portion by one or more spaced fingers extending inside a capture space and against an inside wall of the collector.

In one form, an exterior of a collector portion is positioned adjacent a leg portion with a rest face of a collector resting on a lift and a collector retainer portion extending into a capture space to releasably restrain the collector while splitting a log.

In one form of an operational configuration, a collector is positioned between a blade portion and a base portion.

In one form of an operational configuration, one end of a rest face is propped on a lift wall while an opposing end of the rest face rests on a ground surface or on a top surface of a broad plate member or both.

In one form of an operational configuration, a central axis of the collector is non-perpendicular to a ground supporting surface.

In one form of an operational configuration, a floor face of a collector is angled with respect to a ground supporting surface such that kindling that falls into the collector will slide or fall, or slide and fall to one side of the collector for the gravity assisted gathering of split kindling thereby maximizing use of the collector's capture space.

In one form of an operational configuration, a central axis of a collector is non-parallel to the force of gravity.

In one form of an operational configuration, a floor face is angled whereby the elevated portion of the floor face is positioned under a blade portion of a splitter.

In one form of a carry configuration, a collector portion is removed from a splitter for the transport of kindling.

In one form, a user uses a handle portion to carry the collector containing one or more pieces of kindling to a predetermined location.

In one form, a user grasps through a transport aperture in a guide plate to transport entire wood splitter assembly or a portion such as a splitter frame.

In one form, a portion of a splitter frame is disposed over a capture space of a collector portion.

In one form, a first base leg and a first leg strut are manufactured from a single casting.

In one form, a second base leg and a second leg strut are manufactured from a single casting.

In one form, a first base leg, and a first leg strut, and a gusset therebetween are manufactured from a single casting.

In one form, a second base leg, and a second leg strut, and a gusset therebetween are manufactured from a single casting.

In one form, a splitter frame is supported by a collector portion.

In one form, a base portion of a splitter frame rests on an upper rim of a collector portion.

In one form, a base portion of a splitter frame is fully supported by a collector portion.

In one form, a blade portion of a splitter frame is supported by a base strut and one or more leg struts.

In one form, a guide portion is adjustably distanced from a blade portion of a splitter.

In one form, a guide portion is adjustably distanced from a blade portion of a splitter by selective seating within a plurality of spaced guide positioners.

In one form, a splitter frame is disposed on a base portion.

In one form, a blade portion is disposed on a base portion.

In one form, a secondary blade extends transversely from a blade portion for creation of two pieces of kindling with each splitting cycle.

In one form, a secondary blade extends to a base portion to offer additional support to a blade portion.

In one form, a first strut and a second strut extend transversely from a blade portion to a base portion to support the blade portion.

In one form, a guide portion extends from a blade portion to guide a log during a splitting process.

In one form, one or more leg struts extend from a cross member portion to a base portion.

In one form, a blade portion extends from a first face of a cross member.

In one form, one or more guide feet of a guide plate extend from a first face of a cross member.

In one form, a lift extension extends from one or more leg struts to releasably support a collector portion.

In one form, a lift extension supporting a collector portion comprises a lift portion and a lift knob to prevent unintended release of a collector.

In one form, an upwardly extending leg anchor extends from a base portion for releasable fixation of a splitter blade.

In one form, an upwardly extending leg anchor extends from a base portion through a collector aperture formed within a floor of a collector portion.

In one form, a collector aperture is generally centered in a floor of a collector portion along a central axis of said collector portion.

In one form, an extending leg anchor is in the form of a tube or a post sized to engage and releasably fix a leg portion.

In one form, an extending leg anchor is fixed to a leg portion.

In one form, a base portion is positioned inferior to a floor of a collector portion.

In one form, a base portion is positioned superior to a floor of a collector portion.

In one form, a blade portion is disposed on a superior end of a leg portion extending from a capture space of a collector portion.

In one form, a blade portion comprises an entry channel sized for mounting on a leg portion.

In one form, a blade portion resides at a position below a top face of a collector portion.

In one form, a blade portion resides at a position above a top face of a collector portion.

In one form, a blade portion resides at a position generally equivalent to a top face of a collector portion.

In one form, a first leg positioner on a leg portion engages a second leg positioner on a leg anchor to prevent rotational movement between a base portion and a blade portion.

In one form, a first leg positioner is in the form of a pin.

In one form, a second leg positioner is in the form of a notch sufficient to seat the first leg positioner therein.

In one form, a blade portion may be separated from a base portion for removal of a collector portion from a base portion.

In one form, a leg portion extending from a leg anchor comprises one or more angled segments.

In one form, a leg anchor having one or more angled segments positions a blade portion adjacent a top face of a collector portion.

In one form, a base portion comprises base pods of varying heights to cause an angulation of the base.

In one form, a kindling splitter comprises a blade portion mounted directly on a superior face of a collector portion.

In one form, a kindling splitter comprises a collector portion having a central axis that is angled from vertical.

In one form, a kindling splitter comprises a collector portion having a central axis angled from vertical and a floor sloping down and away from said blade portion.

In one form, a kindling splitter comprises a collector housing having a blade portion mounted at a superior aspect thereof and sized for removable seating of a collector portion therein said collector housing.

In one form, a blade portion is formed in unison with a cross member portion.

In one form, a collector retainer portion is formed in unison with a cross member portion.

In one form, a blade portion, a collector retainer portion, and a crossbar portion are formed in unison.

In one form, a lift for supporting a collector is in the form of a rod extending between opposed leg portions.

In one form, a blade portion comprises a second splitter plate angled from a blade portion having a second splitter wall with a second splitter surface formed thereon.

In one form, a cross member portion is supported by one or more support pins extending from a leg portion.

In one form, a cross member portion is supported to a leg portion by one or more threaded fasteners.

In one form, a kindling splitter comprises a single leg portion extending from an upward blade portion. A stake portion for providing in ground support extends from an opposed end of the leg portion. A base portion is positioned between a leg portion and a stake portion and serves to limit the distance in which the stake portion may be driven into ground. A guide portion may be used to guide wood towards a blade portion.

In one embodiment, a method for using a wood splitter comprises the step of placing a splitter frame on sturdy support surface. Placing a collector portion under a blade portion and positioned on a lift to cause a floor face of the collector to be angled. If so desired, adjusting the distance between a guide spacer or guide plate to produce a kindling piece of a predetermined thickness. Placing a log end on top a leading upward edge of an angled blade portion with the side of the log resting against a glide face of a guide spacer or guide face of a guide plate. Stabilizing the log with one hand on a lateral wall of the log away from the blade portion. Impacting a superior end of the log using a mass such as a mallet to cause the log to be split over the blade portion causing a main portion of the log to slide down a second splitter surface and a kindling piece to slide down a first splitter surface of the blade portion towards the high side of a collector. A distal end of the kindling drops to an elevated portion of a floor face of a collector and slides, falls, or slides and falls to the low side of the collector where the kindling pieces are gathered due to the forces of gravity. Removing the collector and newly split kindling from a splitter frame using a bucket handle if so desired and relocating for consumption.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF SELECTED EMBODIMENTS OF THE INVENTION

Embodiments of the invention will now be described with reference to the Figures, wherein like numerals reflect like elements throughout and various embodiments are labeled by a letter family (i.e. A, B, C, D, etc). The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

Figure 1:
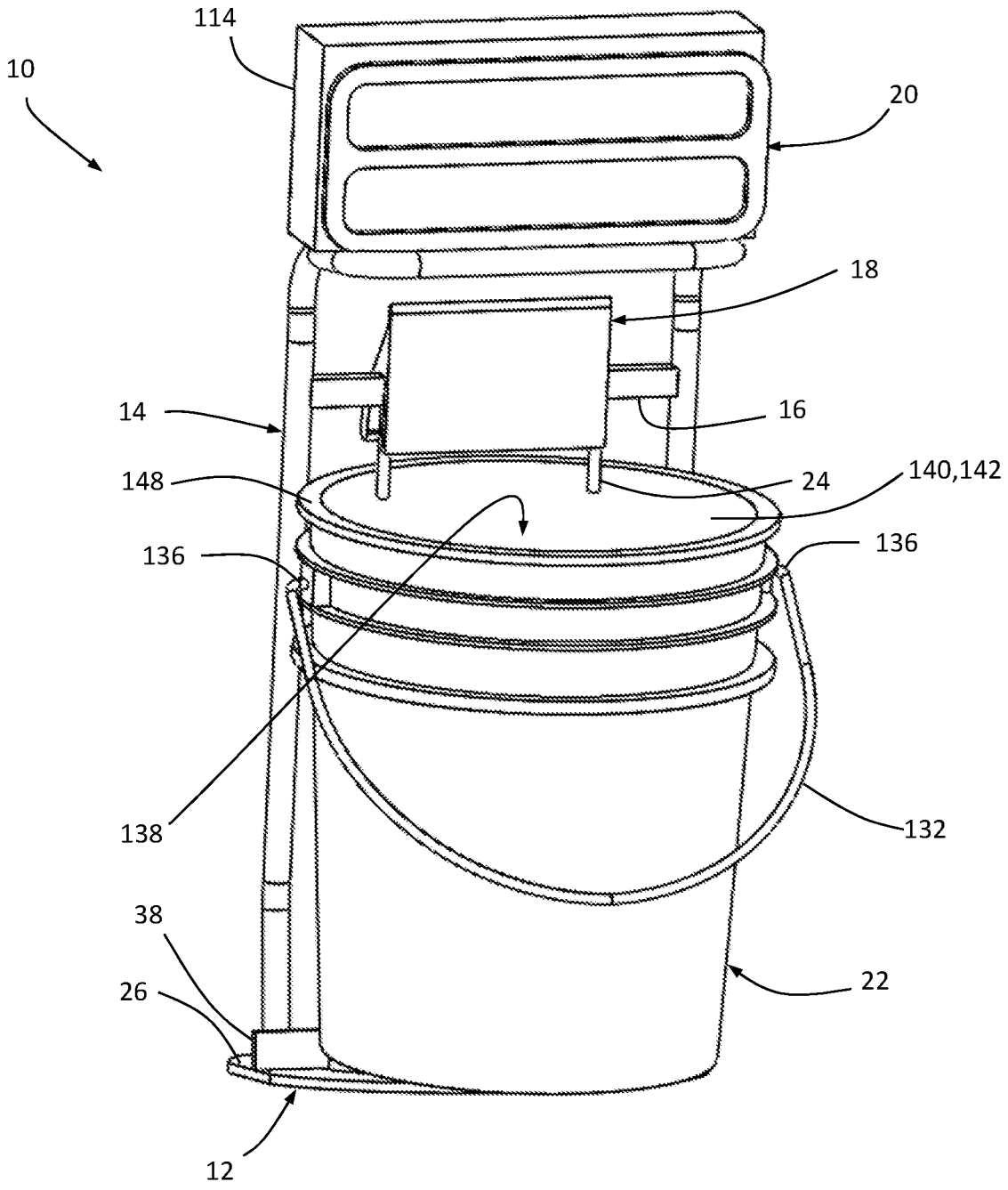
FIG. 1 is front perspective view of a kindling splitter according to one or more embodiments shown and described herein.

FIG. 1 illustrates a preferred embodiment of a wood splitter 10. In this embodiment, a wood splitter 10 (also referred to as a splitter) comprises a base portion 12, a leg portion 14, a cross member portion 16, a blade portion 18, a guide portion 20, a collector portion 22, a collector retainer portion 24, and a lift 38.

Figure 5A:
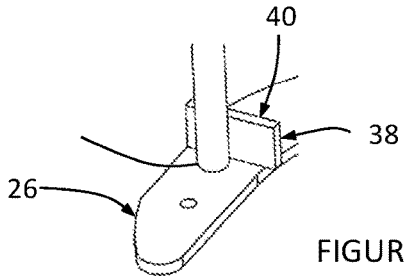
FIG. 5A is a partial close-up perspective view of a lift portion according to one or more embodiments shown and described herein.
Figure 5:
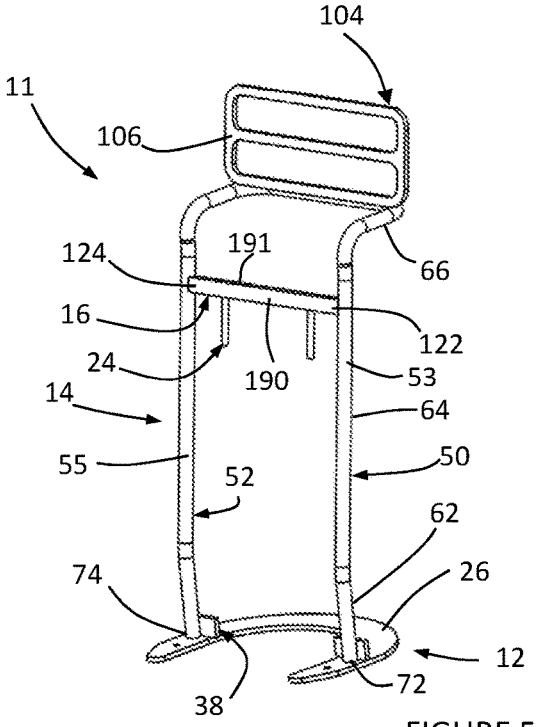
FIG. 5 is a rear perspective view of the kindling splitter illustrated in FIG. 1 with collector portion and blade portion removed according to one or more embodiments shown and described herein.
Figure 6B:
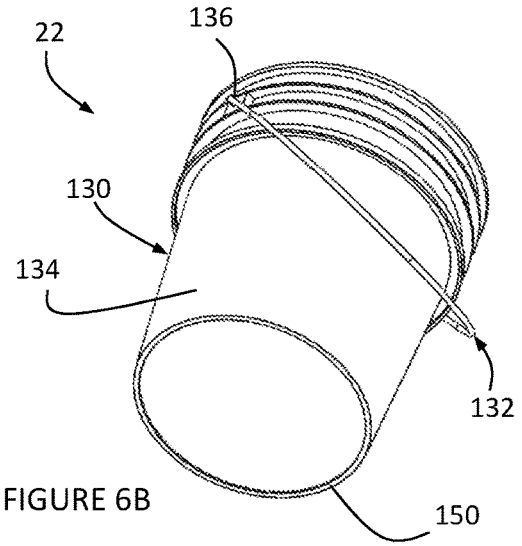
FIG. 6B is a bottom perspective view of one embodiment of a collector portion according to one or more embodiments shown and described herein.
Figure 6:
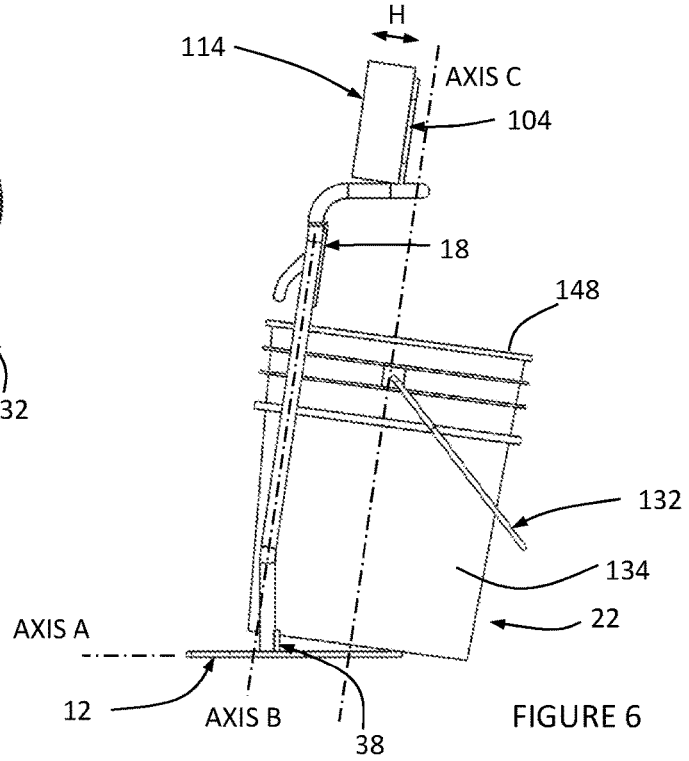
FIG. 6 is a side view of the kindling splitter illustrated in FIG. 1 according to one or more embodiments shown and described herein.
Figure 11:
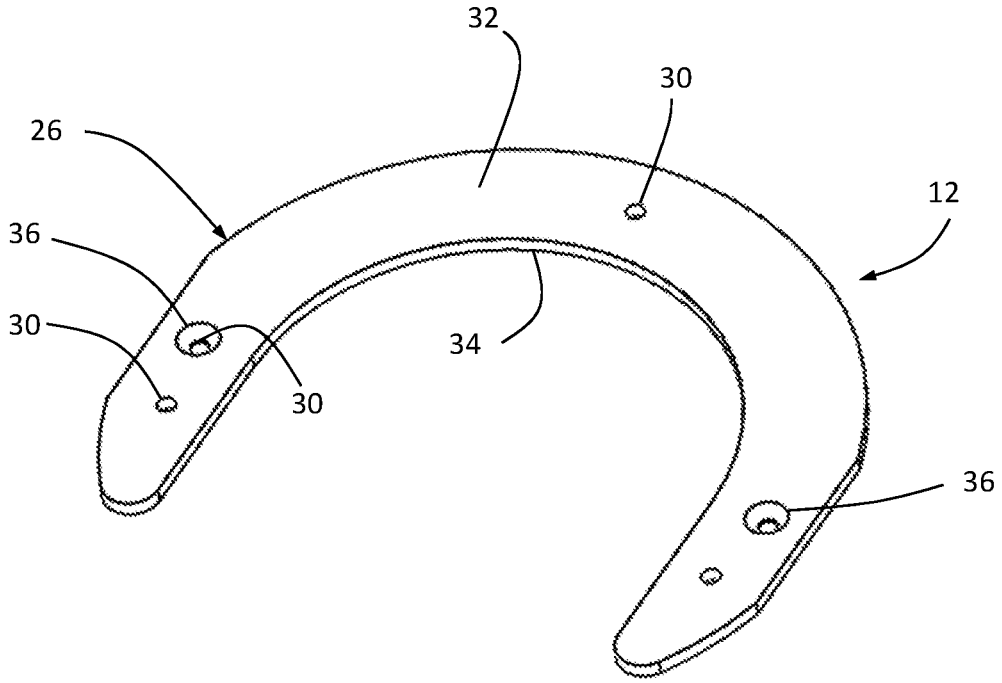
FIG. 11 is a top perspective view of one embodiment of a base portion according to one or more embodiments shown and described herein.

As further illustrated in FIGS. 11 and 5, base portion 12 may be formed of a broad plate member 26. A broad plate member 26 in this embodiment is generally U-shaped however it may have other shaped profiles such as a circle or polygon sufficiently strong and broad for providing a safe and steady base for when the wood splitter encounters impact during wood splitting. In alternative embodiments, a base portion 12 may be formed of individual pods like a tripod or four pods like a standard chair.

A broad plate member 26 may comprise one or more base fastener holes 30 extending between a top surface 32 to a bottom surface 34 on the broad plate member 26 as illustrated in FIG. 11. One or more of the base fastening holes 30 may include a chamfered edge 36 extending from a top surface 32 towards the bottom surface 34 to accommodate fasteners with angled screw heads. Each fastening hole is sized to pass the shank of a screw, bolt, or threaded rod for fastening base portion 12 to a stable surface such as a large flat surface of a stump to secure splitter 10 during use if so desired. The use of fasteners to secure base portion 12 is optional and in many cases may be unnecessary. In alternative embodiments, base portion 12 comprises a plurality of base pods (172E, 172F) of either equal or unequal heights such as those illustrated in FIGS. 28 and 30.

In this embodiment (FIG. 5), broad plate member 26 is formed from a plate of steel and comprises one or more lifts 38 extending upwards from a top surface 32 of a base portion 12. Here (FIG. 13), lift 38 is positioned to lift one end of a collector portion 22 to cause kindling 60 split from a log 58 to fall into a high side 162 of capture space 138 of collector portion 22 then slide by the force of gravity towards a low side 164 of capture space 138 of collector portion 22 thereby causing kindling 60 pieces to collect on a low side 164 of the collector. Gravitational movement of the kindling 60 towards the low side 164 of collector portion 22 provides new space on the high side 162 of collector portion 22 such that each newly split pieces of kindling 60 will fill and stack in collector portion 22 during a splitting operation with little need for handling of the kindling 60 by the user during the splitting operation. The user may then withdrawal sticks of kindling from the collector as needed, or may remove and relocate collector portion 22 with kindling contained therein from the splitter 10 apparatus. The steps required in prior art techniques of gathering split kindling pieces spewed across the ground then piling them for transport is eliminated thus providing ergonomic benefits to the user.

Figure 2:
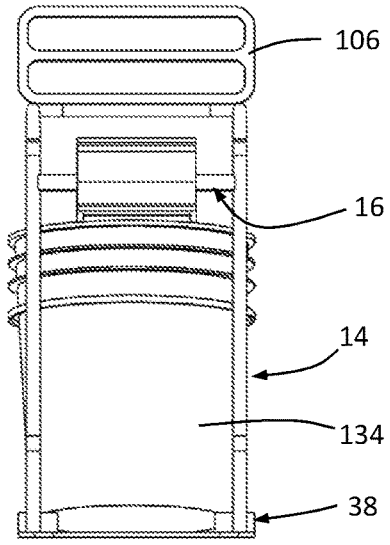
FIG. 2 is a rear view of the kindling splitter illustrated in FIG. 1 according to one or more embodiments shown and described herein.
Figure 3:
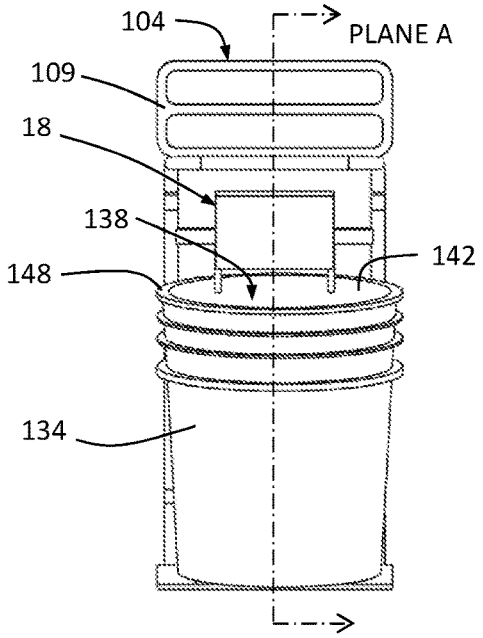
FIG. 3 is a front view of the kindling splitter illustrated in FIG. 1 according to one or more embodiments shown and described herein.

As illustrated in FIG. 1, the one or more lifts 38 may be in the form of generally vertical plates or may assume other forms such as a wedge, post, rod, or notch capable to cause a lift on one portion of a collector to utilize gravitational forces for automatic kindling collection. The one or more lifts 38 comprise a lift wall 40 (FIG. 5A) on which a collector portion 22 can rest. The one or more lifts 38 are positioned under an inferior end of a collector portion 22 as best illustrated in FIG. 2. In this embodiment, lift 39 is welded to base portion 12 and leg portion 14 however other methods such as fasteners may be used. In some embodiments, an elevated bar, tube, or wire spanning between leg portions may be used for the same purpose.

In alternatives embodiments, lift 38 is unnecessary due to features of the collector. For example, the collector portion 22 may comprise a sloped floor or insert thereby creating a similar high side 162 and low side 164 within a collector without the need for a lift. Similarly, a lift may be added or integrated to the body of a collector such that a collector sits at an angle. In yet another alternative embodiment, collector retainer portion 24 may be configured to not only restrain collector portion 22 but to also angulate collector portion 22. For example, a collector retainer may be formed to also engage the outside lip of a bucket causing it to lift, or alternatively, collector retainer may be in the shape of a hook that extends through an aperture in the side of a collector causing the collector to securely hang at an angle. Each of these and other similar arrangements are contemplated to provide a gravity assisted kindling collection system as demonstrated in the illustrated embodiments.

Figure 4:
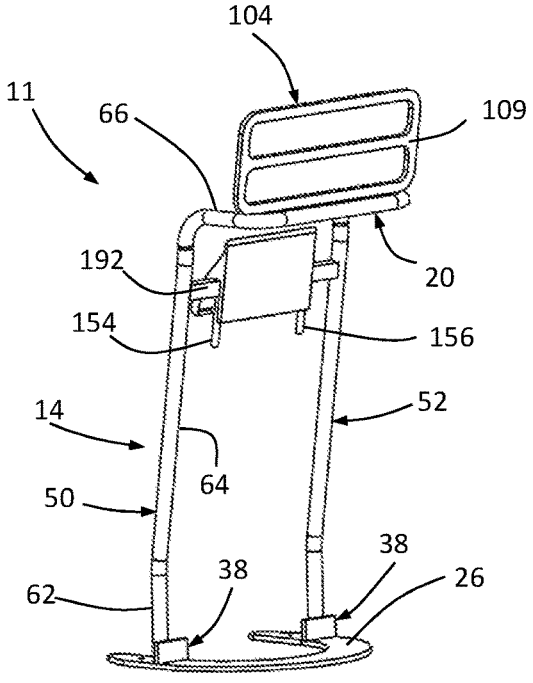
FIG. 4 is a front perspective view of the kindling splitter illustrated in FIG. 1 with collector portion removed according to one or more embodiments shown and described herein.

In an embodiment illustrated in FIG. 4, a leg portion 14 angles as it extends superiorly from a base portion 12. In this embodiment, leg portion 14 is fixed to base portion 12 using a weld however in other embodiments leg portion 14 is removably fixed to base portion 12 using fasteners. For example, a fastener may be extended through the bottom of broad plate member 26 into threaded holes (not shown) extending into first leg end 72 or second leg end 74 or both of leg portions 49. In this embodiment, leg portion 14 comprises a first leg strut 50 and a second leg strut 52 spaced sufficiently from said first leg strut 50 to place a wood log 58 therebetween. Leg portion 14 may be angled its entire length from base portion 12, however in preferred embodiments the first leg strut 50 comprises vertical segment 62, an angled segment 64, and a guide segment 66.

In this embodiment (FIG. 4), vertical segment 62 extends to an angled segment 64 and an angled segment 64 extends to a guide segment 66. Guide segment 66 extends between first leg strut 50 and second leg strut 52 and in this form, first leg strut 50 and a guide portion 20 and second leg strut 52 are formed from a single piece of metal such as a bar or tube but alternatively may be formed from other materials such as sheet metal. In some embodiments guide segment 66 is configured generally perpendicular to guide plate 104 such that guide spacer 114 is well supported on two sides. In alternative embodiments a first leg strut 50 and a second leg strut 52 remain separate and are joined by one or more of: broad plate member 26 and cross member portion 16 and guide plate 104. Vertical segment 62 comprises a first leg end 72 and a second leg end 74 for fixation to base portion 12.

As the embodiment of FIG. 5 illustrates, a cross member portion 16 illustrated here in the form of an elongate bar or tube extends between the first leg strut 50 and the second leg strut 52. Here, a first end 122 of cross member portion 16 is welded to a first outer surface 53 of first leg strut 50 and a second end 124 of the cross member portion 16 is welded to second outer surface 55 of said second leg strut 52. Cross member portion 16 in some forms has a cross-sectional profile that is square or rectangular.

Figure 7:
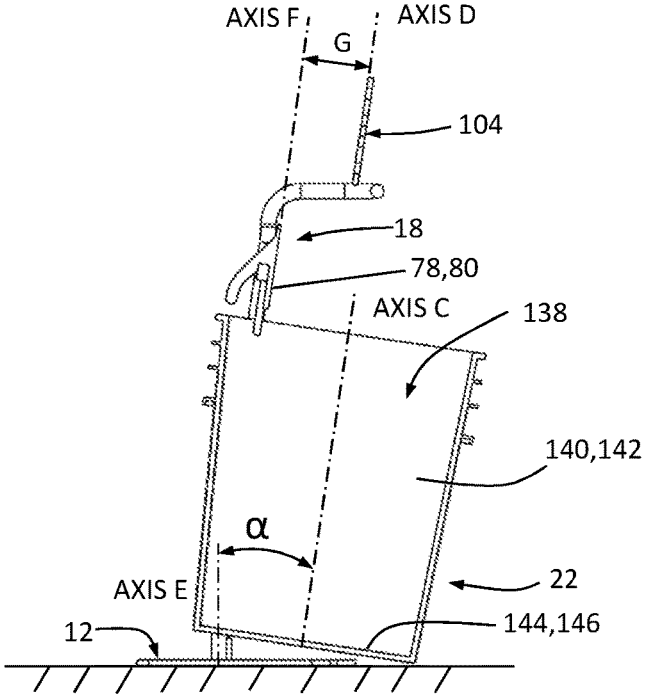
FIG. 7 is a cross sectional view through plane A as illustrated in FIG. 3 according to one or more embodiments shown and described herein.

As illustrated in the Figures, blade portion 18 is supported by said cross member portion 16 from axial and rotational movements. In some embodiments blade portion 18 is welded or fastened in place and has a bi-modal splitting character. Blade portion 18 (FIG. 9,9B, 10) comprises a leading upward edge 76 and comprises a first splitter wall 78 with a first splitter surface 80 thereon and a second splitter wall 82 with a second splitter surface 84 thereon. Splitter surfaces 80, 84 are angled to accomplish specific functions of first cutting by upward edge then wedging apart the kindling from the log as a log is impacted downward. The sharp leading upward edge 76 is configured to cut into a log 58 descending generally along Axis F due to impact on a superior surface of the log by the user typically from a mallet. In this embodiment, Axis F is inclined to generally align with a common single armed mallet swing angle of a user whereby a mallet begins at a raised lateral position and travels downward towards a medial plane of a user's body as it impacts a log (see 'impact force' FIG. 13). First splitter surface 80 is generally parallel to Axis F to direct a severed piece of split kindling 60 towards a high side 162 of a collector portion 22. Second splitter surface 84 is angled with respect to first splitter surface 80 to cause a fracture within log 58 as the log is downwardly impacted. Angulation β (FIG. 9) between splitter surfaces 80 and 84 is preferably optimized to ease the work of splitting. Blade portion 18 comprises a first side face 86 and an opposing second side face 88 at lateral ends of the blade portion 18. In an alternative embodiments, blade portion 18 is secured directly to leg portion 14 using for example welds or fasteners in the absence of a cross member portion 16. In the embodiment of FIG. 7, a central axis C of collector portion 22 and axis F of blade portion 18 are generally parallel however, in other embodiments these axes are non-parallel to further assist with directing kindling towards a predetermined location within a collector portion 22.

Figure 9:
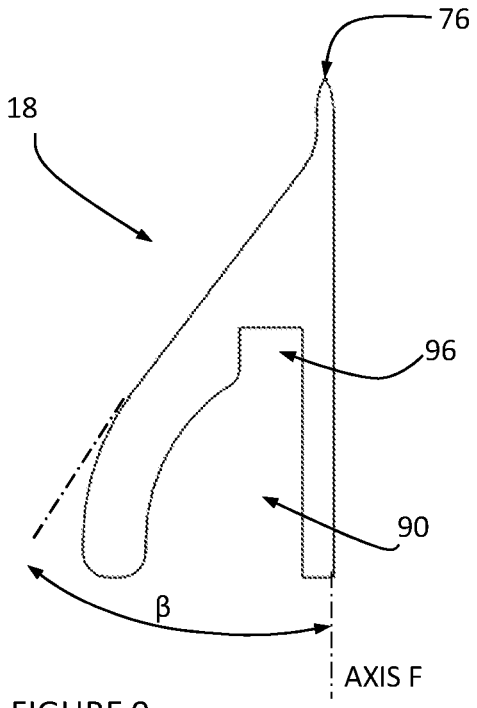
FIG. 9 is a side view of one embodiment of a blade portion according to one or more embodiments shown and described herein.
Figure 9B:
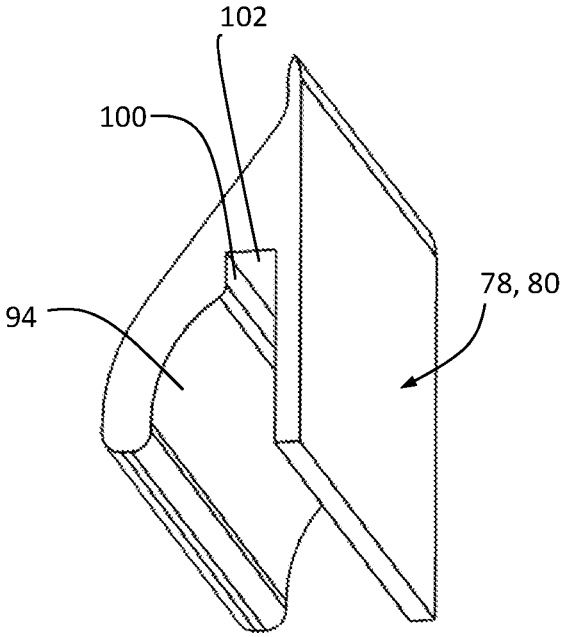
FIG. 9B is a side perspective view of the blade portion illustrated in FIG. 9 according to one or more embodiments shown and described herein.
Figure 10:
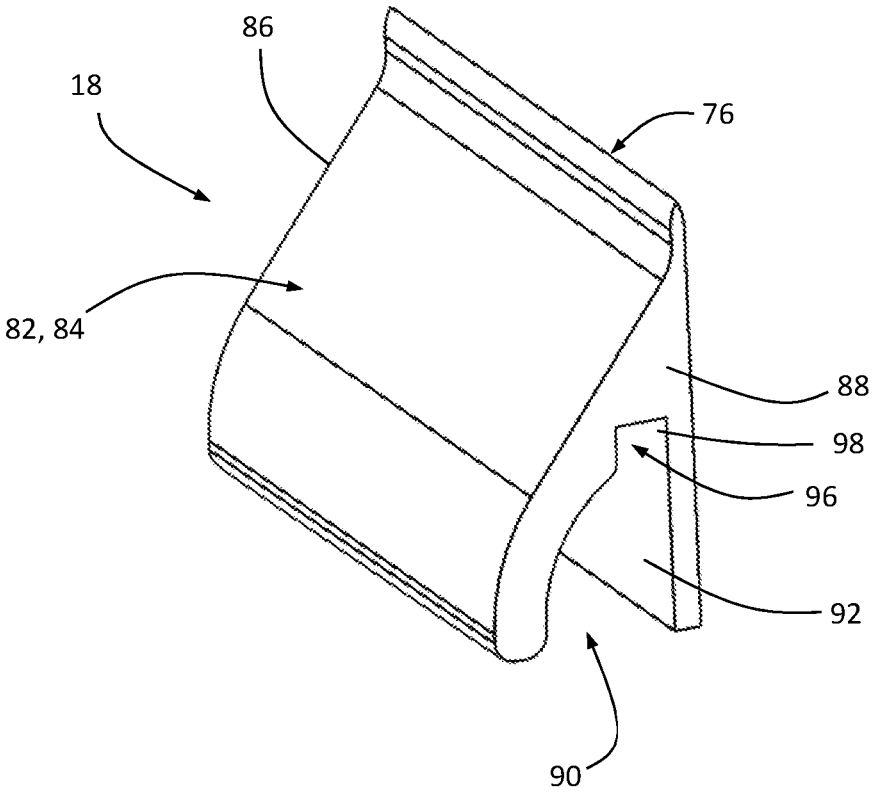
FIG. 10 is a top perspective view of the blade portion illustrated in FIG. 10 according to one or more embodiments shown and described herein.

In the embodiment of FIG. 9, 9B, 10, blade portion 18 comprises an entry channel 90 with opposed first entry face 92 and second entry face 94 thereon. Cross channel 96 extends from entry channel 90 for seating of cross member portion 16 therein. Cross channel 96 comprises an opposed first cross channel face 98 and second cross channel face 100 for positioning against cross member portion 16 to prevent lateral movement. Force face 102 extends between the first cross channel face 98 and second cross channel face 100 and rests against cross member portion 16 maintaining its vertical height. In this configuration, blade portion 18 may be lifted off cross member portion 16 for eased sharpening.

Guide portion 20 comprises guide segment 66 and a guide plate 104 extending from the guide segment 66 (FIG. 104). In some forms, guide plate 104 is welded, fastened or otherwise fixed to guide segment 66 whereas in alternative embodiments guide plate 104 is removable from the guide segment 66 by interlocking with a portion of the guide segment 66.

Figure 12:
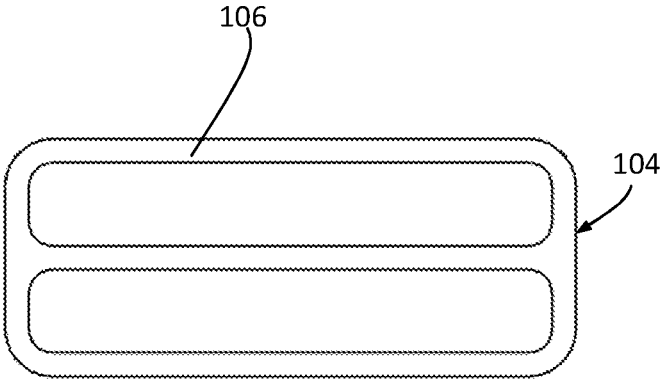
FIG. 12 is a front view of one embodiment of a guide plate according to one or more embodiments shown and described herein.
Figure 12A:
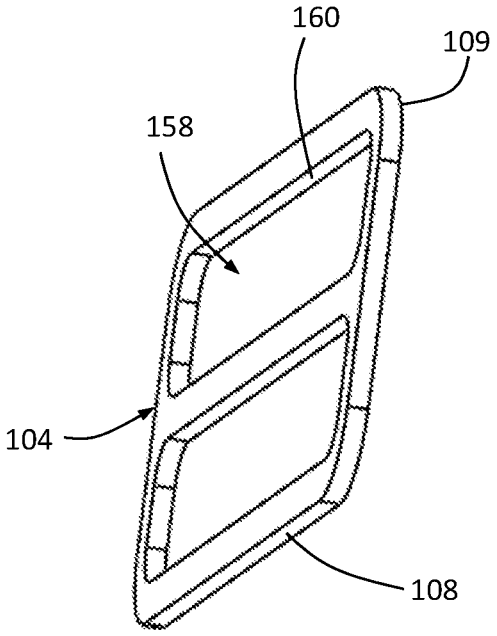
FIG. 12A is a front perspective view of the guide plate illustrated in FIG. 12 according to one or more embodiments shown and described herein.

Guide plate 104 (FIG. 12, 12A) comprises a guide face 106 to provide counter acting normal forces to a guide spacer 114 or a log 58 or a guide spacer 114 and a log 58 during use. Guide plate 104 is angled along axis D such that a log 58 will be guided down a preferred cutting path over leading upward edge 76 of blade portion 18. In this embodiment, guide plate 104 comprises a mount face 108 opposing said guide segment 66 and fixation therebetween. Guide plate 104 also comprises a back face 109.

Figure 8:
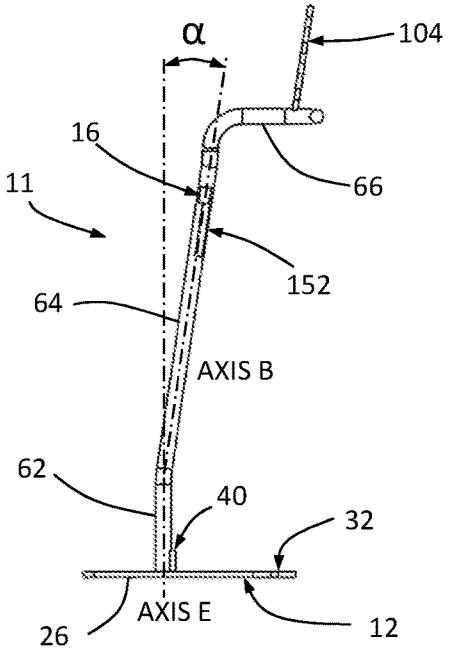
FIG. 8 is a side view of the kindling splitter illustrated in FIG. 1 with collector portion and guide spacer and blade portion removed according to one or more embodiments shown and described herein.

FIG. 8 illustrates a splitter frame 11 wherein collector portion 22, blade portion 18, and guide spacer 114 are removed. In this embodiment (FIG. 7, 8), guide plate 104 is generally parallel to a first splitter wall 78. Guide plate 104 is also generally parallel to the angled segment 64. In one form, a guide spacer 114 resides against guide plate 104 and may be in the form of a block of wood. In alternative forms, guide spacer 114 may vary in thickness or a plurality of guide spacers 114 of different thicknesses may be provided to provide the user options for kindling thickness. In this embodiment, guide spacer 114 comprises a glide face 116 for gliding abutment against a log 58, an abutment face 120 for opposing a guide face 106 of a guide plate 104, and a foot face 118 for support by guide segment 66.

In preferred embodiments, guide spacer 114 resides against guide face 68 of the guide segment 66. Guide plate 104 is spaced from blade portion 18 sufficient to pass a split piece of kindling 60 wood therebetween. This distance is labeled as G in FIG. 7. If also using a guide spacer 114, guide plate 104 is also spaced from blade portion 18 sufficient to pass a split piece of kindling 60 wood therebetween. In alternative embodiments, guide plate 104 is variably distanced from leading upward edge 76 of a blade portion 18 to split various thicknesses of kindling 60. In another alternative form, guide spacer 114 thickness and guide plate 104 position cooperate to provide a predetermined split thickness of kindling 60.

In preferred embodiments, collector portion 22 comprises a capture space 138 in which kindling 60 parts are collected after splitting across blade portion 18. Collector portion 22 is therefore positioned below to collect kindling 60 parts falling from a blade portion 18 after splitting a log 58. In preferred forms, collector portion 22 is in the form of a bucket 130. In preferred forms, bucket 130 is generally cylindrical and further is of a standard five gallon variety commonly available at home improvement stores.

In this embodiment, bucket 130 comprises a bucket handle 132 wherein the handle is formed of a bent metal rod. Bucket 130 comprises an exterior 134 wherein opposing handle ends 136 of bucket handle 132 are pivotably attached to exterior 134 at a superior end of bucket 130. A capture space 138 is defined by one or more side walls 140 which are upstanding and wherein the side walls have an inside surface 142 thereon. Capture space 138 is defined by a floor 144 wherein the floor comprises a floor face 146. In this embodiment, inside surface 142 intersects a floor face 146. Collector portion 22 also comprises a top face 148 at a superior end and a rest face 150 at an inferior end.

Figure 13:
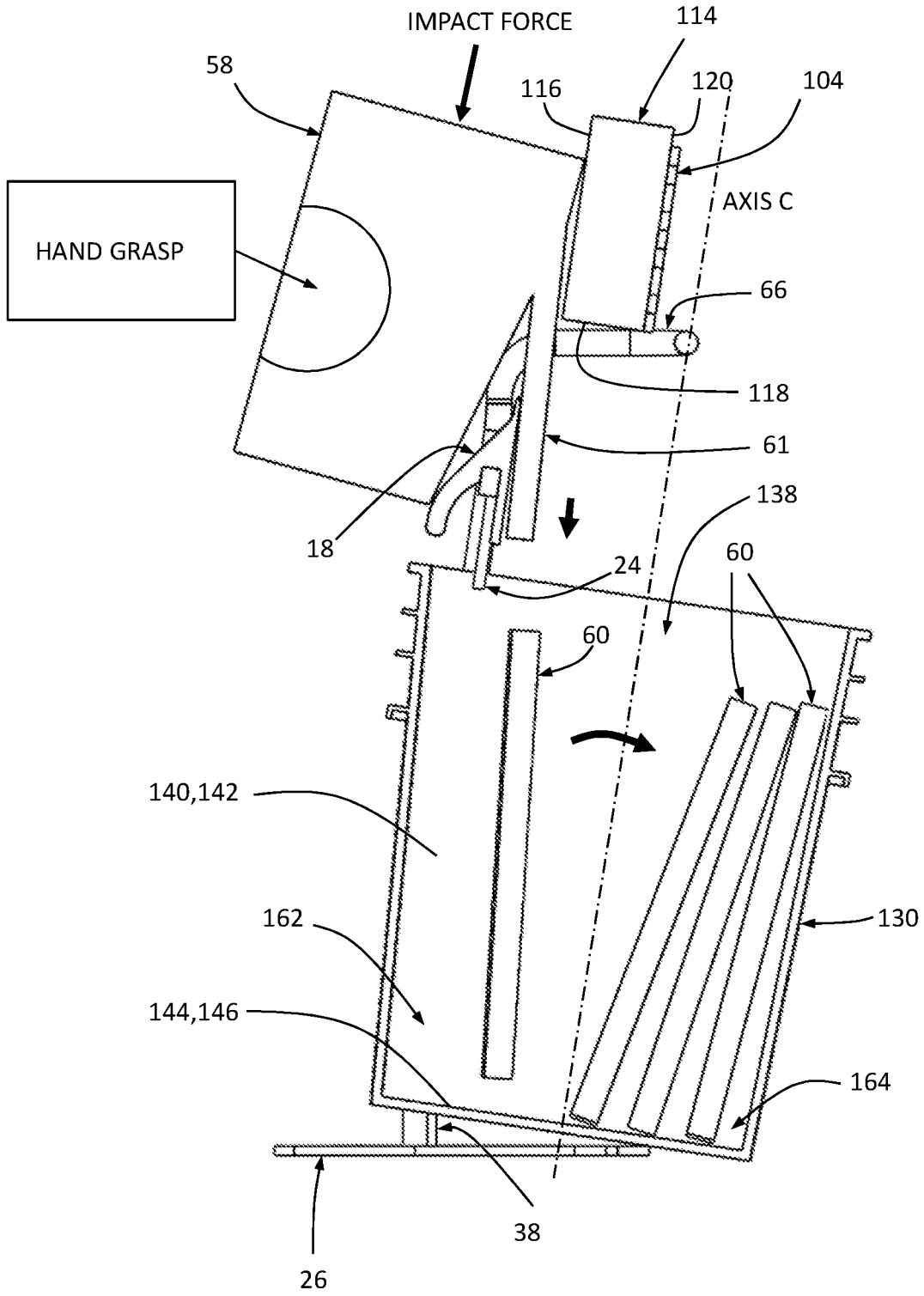
FIG. 13 is a cross section view through plane A of a kindling splitter illustrating a log being split by a blade portion and illustrating a kindling piece falling into a collector and gathering on a low side of a collector according to one or more embodiments shown and described herein.
Figure 14:
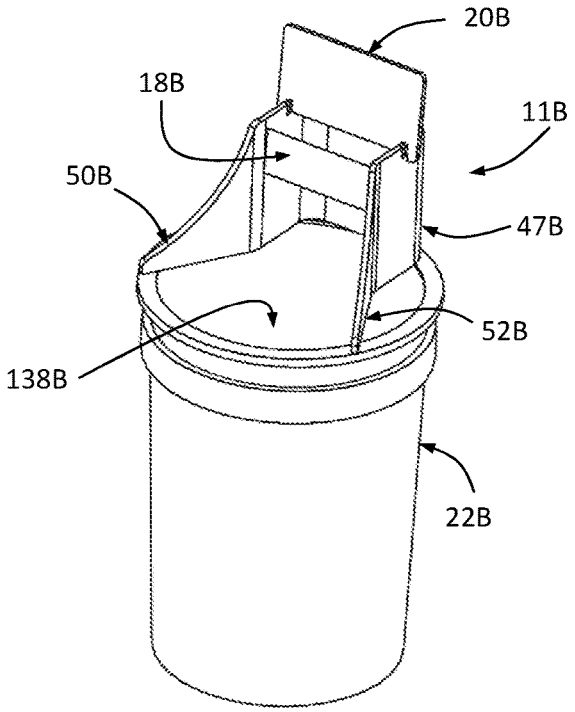
FIG. 14 is a perspective view of one embodiment of a kindling splitter wherein a splitter frame is disposed over capture space of a collector portion according to one or more embodiments shown and described herein.
Figure 15:
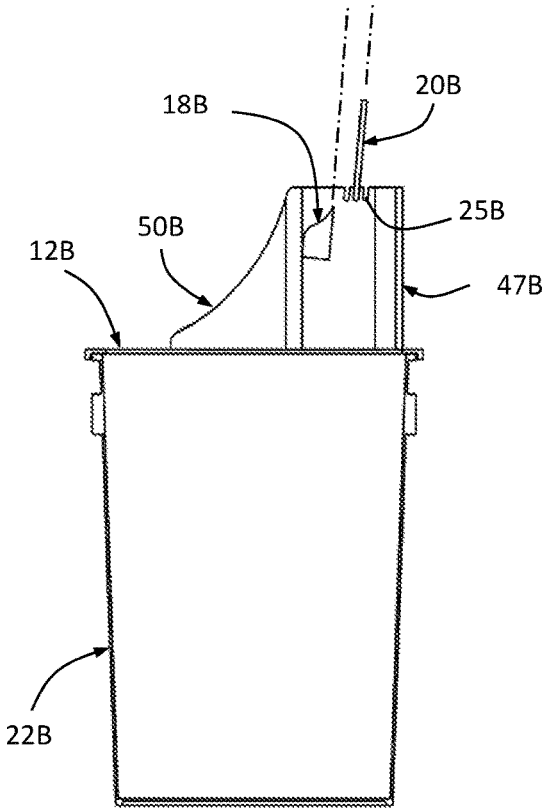
FIG. 15 is a cross section view of the kindling splitter illustrated in FIG. 14 according to one or more embodiments shown and described herein.
Figure 16:
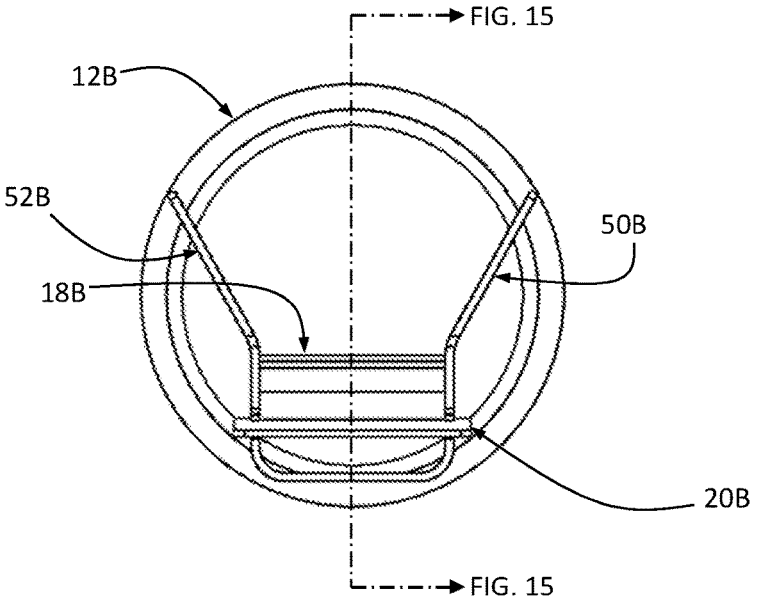
FIG. 16 is a top view of the kindling splitter illustrated in FIG. 14 according to one or more embodiments shown and described herein.
Figure 17:
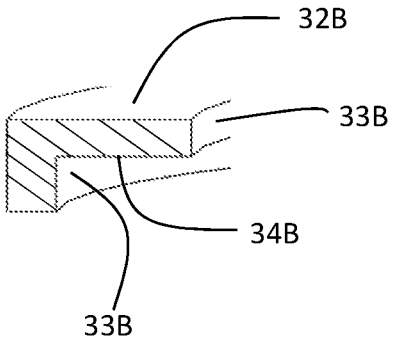
FIG. 17 is a partial cross sectional view of a base portion of the kindling splitter of FIG. 14 according to one or more embodiments shown and described herein.
Figure 18:
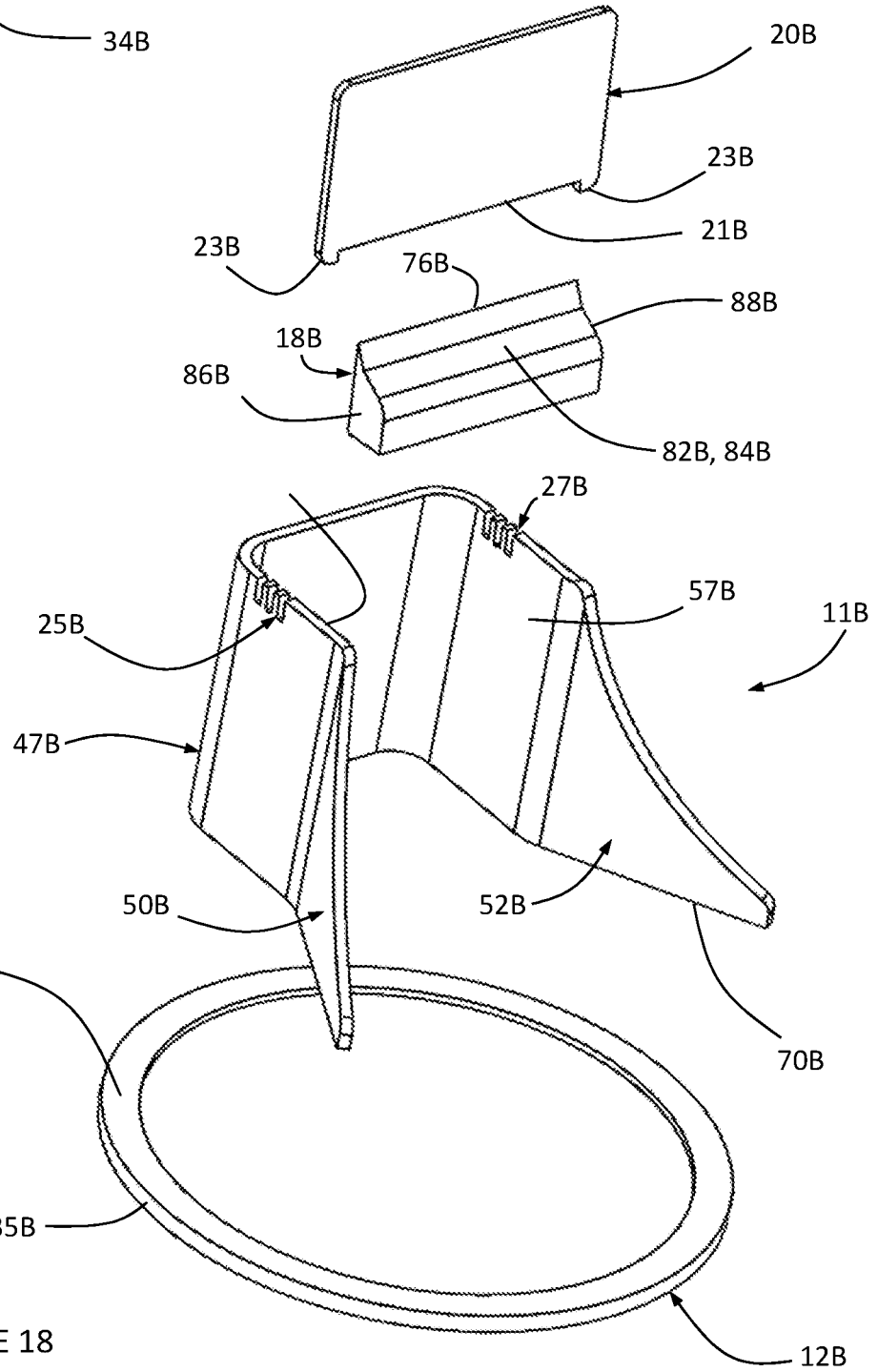
FIG. 18 is an exploded perspective view of upper portions of the kindling splitter of FIG. 14 according to one or more embodiments shown and described herein.

As illustrated for the embodiment in FIGS. 5 and 13, a collector retainer portion 24 may extend inferiorly below blade portion 18. Collector retainer portion 24 is in the form of one or more fingers 152 such as a first spaced finger 154 and a second spaced finger 156 extending inside a capture space 138 and against an inside surface 142 holding collector portion 22 in a predetermined position below blade portion 18 yet providing easy removal. Exterior 134 of a collector portion 22 is positioned adjacent a leg portion 14 with a rest face 150 of a collector portion 22 resting on a lift 38 and a collector retainer portion 24 extending into a capture space 138 to releasably restrain the collector portion 22 while splitting a log 58.

An operational configuration of a preferred embodiment is illustrated in FIG. 1. As illustrated, a collector portion 22 is positioned between a blade portion 18 and a base portion 12. One end of rest face 150 is propped on a lift wall 40 while an opposing end of the rest face 150 rests on a ground surface or in alternative embodiments on a top surface 32 of a broad plate member 26. Central axis-C of the collector portion 22 is non-perpendicular to a ground supporting surface as evidenced by angle $\alpha$ between axis C and axis E in FIG. 7.

Also in this embodiment, floor 144 and floor face 146 of a collector portion 22 (illustrated in FIG. 13 as a bucket 130) is angled with respect to a ground supporting surface such that kindling 60 falling into capture space 138 of collector portion 22 will slide or fall, or slide and fall to one side of collector portion 22 for the gravity assisted gathering of split kindling 60. Accordingly, central axis-C of the collector portion 22 is non-parallel to the force of gravity which generally acts along axis-E.

In one form of an operational configuration, a floor face 146 is angled whereby the elevated portion of the floor face 146 is positioned under a blade portion 18 of a splitter 10. In one form of a carry configuration, a collector portion 22 is removed from splitter frame 11 for the eased and efficient transport of kindling 60 after the kindling is split and collected in a collector portion 22. A user may use bucket handle 132 portion to carry the collector portion 22 containing one or more pieces of kindling 60 to a predetermined location where it can be stored or consumed.

In an alternative embodiment illustrated in FIGS. 14-18, a splitter frame 11B is disposed over a capture space 138B of a collector portion 22B such that kindling split over blade portion 18B falls into collector portion 22B. Here splitter frame 11B is fully supported by top face 148B of collector portion 22B. A blade portion 18B of splitter frame 11B is supported by base strut 47B and first leg strut 50B and second leg strut 52B. Further to this embodiment, guide portion 20B is adjustably distanced from blade portion 18B by selective seating within a plurality of spaced first guide positioners 25B and second guide positioners 27B. First side face 86B and second side face 88B of blade portion 18B are held to opposed interior faces 57B of base strut 47B by one or more of screws, welds, and other similar elements such as pins and rods as is base portion 12B secured to splitter frame 11B.

Figure 19:
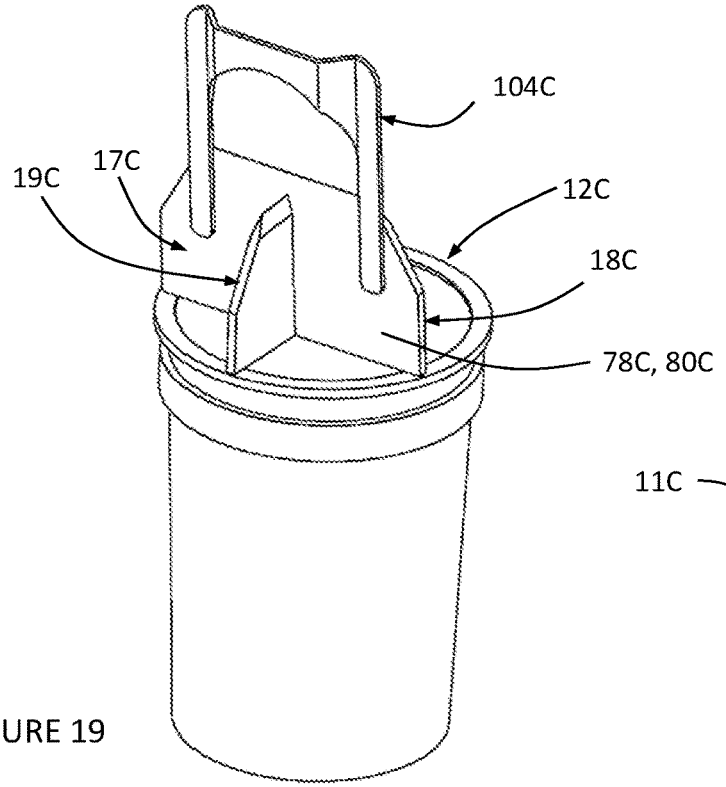
FIG. 19 is a perspective view of another embodiment of a kindling splitter with splitter disposed on top of a collector portion according to one or more embodiments shown and described herein.
Figure 20:
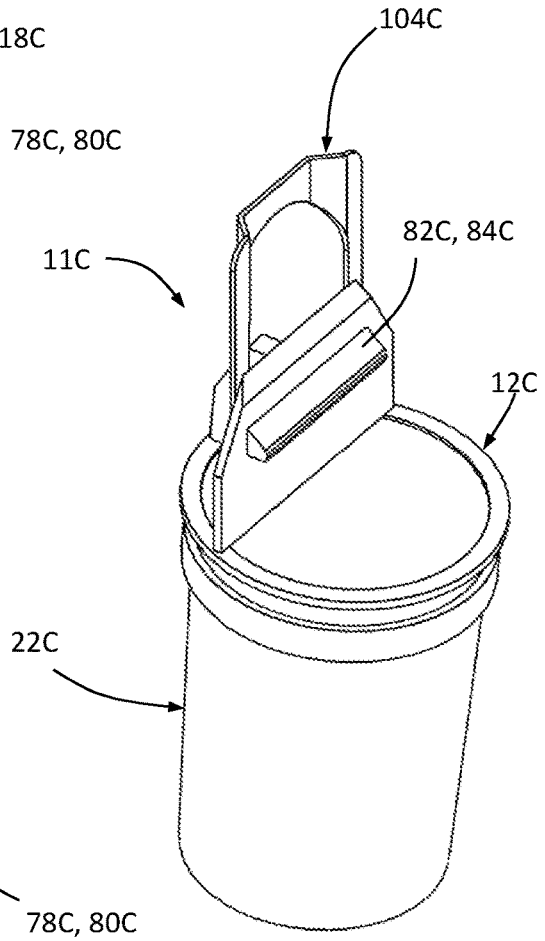
FIG. 20 is an alternative perspective view of the embodiment illustrated in FIG. 19 according to one or more embodiments shown and described herein.
Figure 21:
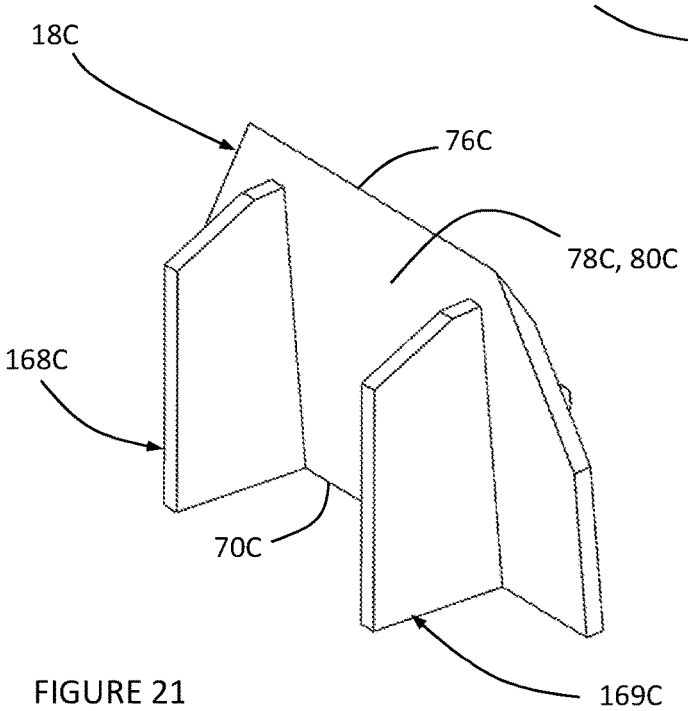
FIG. 21 is a close up perspective view of an alternative support system of a splitter blade using a pair of spaced struts for blade support according to one or more embodiments shown and described herein.
Figure 22:
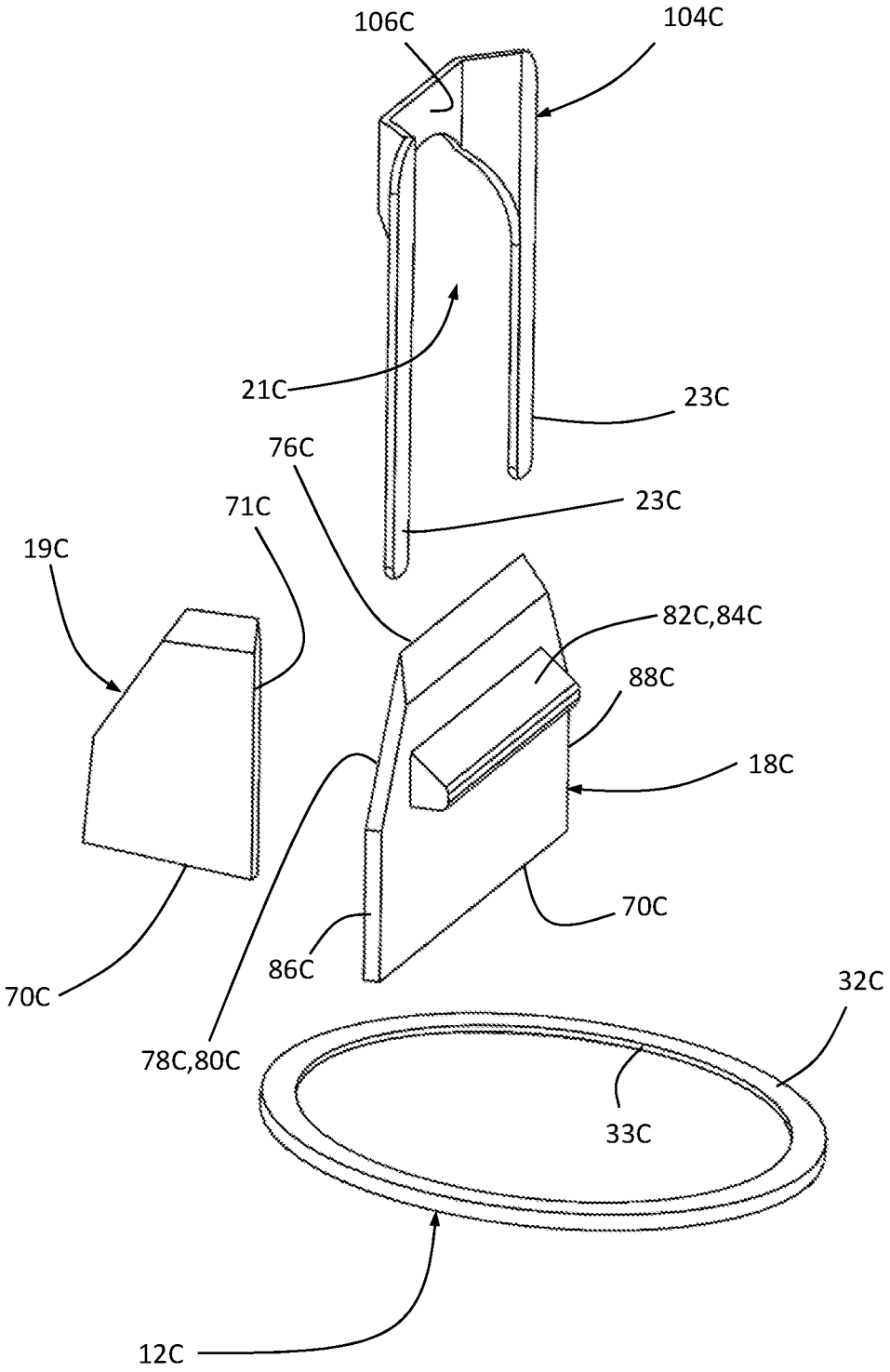
FIG. 22 is an exploded perspective view of a blade assembly of FIG. 19 according to one or more embodiments shown and described herein.

In yet another embodiment illustrated in FIG. 19-22, a blade portion 18C is enlarged to also substantially serve as a splitter frame 11C and fixed on base portion 12C. In this embodiment, secondary blade 19C is fixed to first splitter surface 80C and extends transversely from blade portion 18C to collector portion 22C providing additional support to blade assembly 17C during splitting impact. In alternative embodiments where collector portion 22C is of sufficient strength and material type (i.e. manufactured from metals such as steel), base portions such as 12C and 12B may be eliminated and the corresponding splitter frame may be one or more of; fixed to a collector portion (i.e. welds), and removably engaged with a collector portion (i.e. notches on splitter frame engaging rim on collector portion thus holding splitter frame in position but also providing for instant removal by a user). The use of a secondary blade such as 19C extends transversely from blade portion 18C thus creating of two pieces of kindling with each splitting cycle. Guide portion 104C may be utilized to guide a log towards a leading upward edge 76C during splitting. In this embodiment, guide feet 23C are secured by one or more of welds and fasteners to first splitter wall 78C. Guide channel 21C serves to; lighten guide portion 104C, provide space between guide portion 104C and blade portion 18C to minimize jamming therebetween, and defines guide face 106C used to guide logs towards blade portion 18C. In this embodiment, guide face 106C is offset from each guide foot 23C. Guide channel 21C provides the use of guide face 106C as a carrying handle in which a user may separate a splitter frame portion from a collector portion. A second splitter wall 82C having a second splitter surface 84C extends from blade portion 18C to cause wedging between a log and a kindling portion therein causing the kindling to split from the log. This blade is therefore bimodal in that it has a thin leading upward edge 76C in a first mode and a wedging second splitter wall 82C in a second mode. Secondary blade 19C may be configured such that its leading upward edge misaligns (as illustrated in FIG. 19) or aligns with leading upward edge 76C of blade portion 18C. In an alternative embodiment as illustrated in FIG. 21, a first strut 168C and a second strut 169C extend transversely from a blade portion 18C to a base portion to support blade portion 18C.

Figure 23:
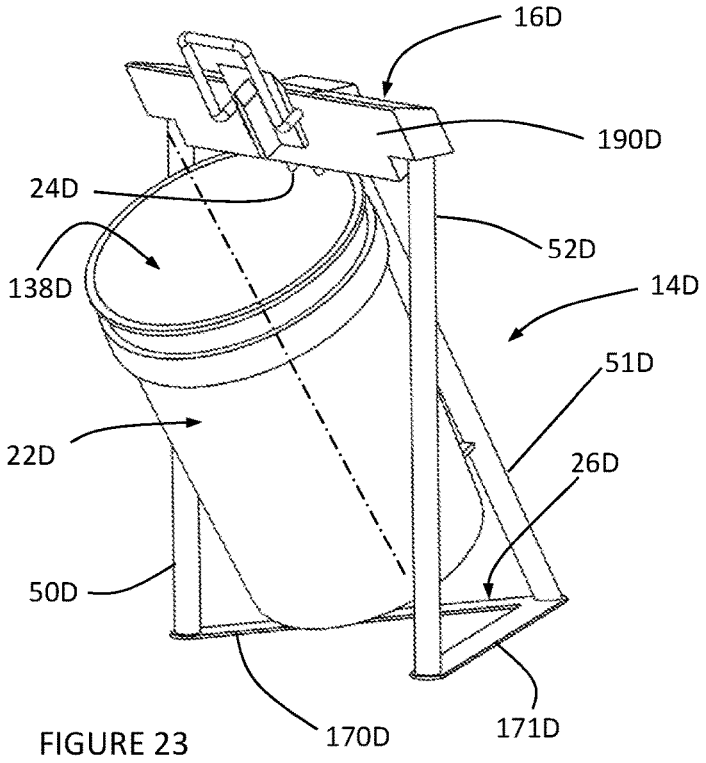
FIG. 23 is a perspective view of yet another embodiment of a kindling splitter whereby a collector portion is supported by a plurality of leg struts according to one or more embodiments shown and described herein.
Figure 24:
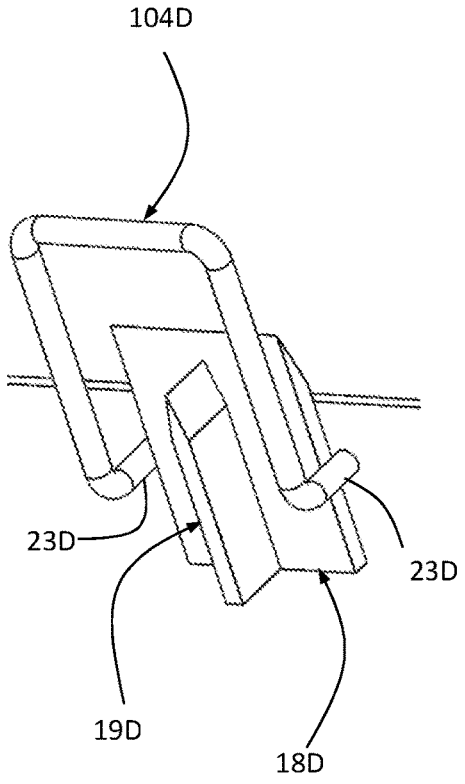
FIG. 24 is a partial close perspective view of a blade and guide plate portion of the embodiment illustrated in FIG. 23 according to one or more embodiments shown and described herein.
Figure 25:
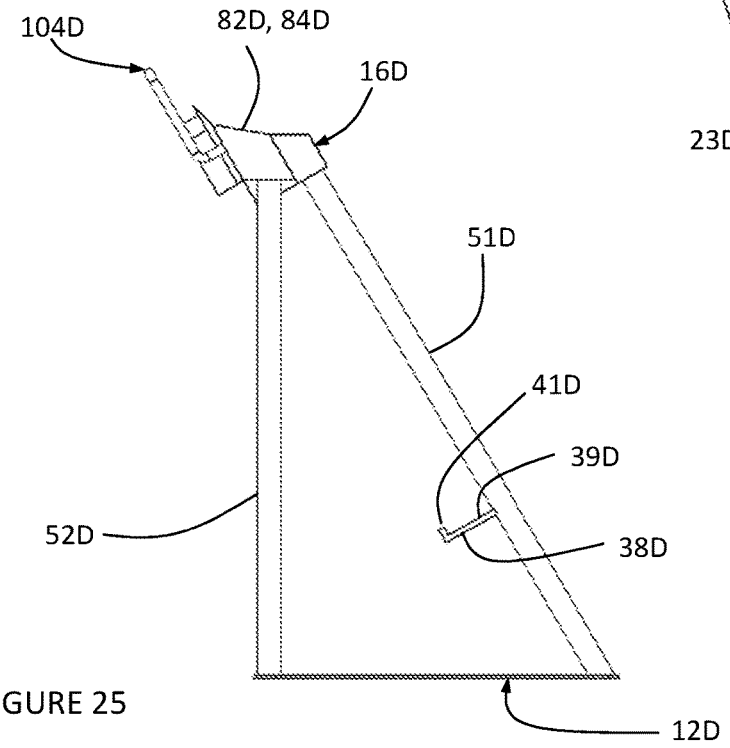
FIG. 25 is a side view of the blade and guide and leg portion (collector portion removed) of the kindling splitter of FIG. 23 according to one or more embodiments shown and described herein.

In yet another embodiment, one or more leg struts extend from a cross member portion to a base portion. As illustrated in FIG. 23-25, first leg strut 50D, and second leg strut 52D, and third leg strut 51D extend between cross member portion 16D and base portion 12D. Blade portion 18D upwardly extends from first face 190D of cross member portion 16D. One or more guide feet 23D of guide plate 104D extend from first face 190D of cross member portion 16D. In this embodiment, a lift 38D extends from one or more leg struts (illustrated here extending from a centered third leg extension) to releasably support a collector portion 22D. Lift 38D may comprise a lift extension 39D and a lift knob 41D to prevent unintended release of a collector. A collector retainer portion 24D extends inferiorly from cross member portion 16D and works collaboratively with lift 38D to releasably hold collector portion 22D below blade portion 18D and preferably at an angle to bias kindling towards one side of capture space 138D upon log splitting. A log driven against a leading upward edge 76D of blade portion 18D is split with a log portion wedged away from kindling by second splitter wall 82D formed on cross member portion 16D. Blade portion 18D may comprise a secondary blade 19D to form two pieces of kindling with each splitting impact. In preferred forms, one or more of first and second and third leg struts 50D,51D,52D are detachable from one or more of cross member portion 16D and base portion 12D for compact storage. In other embodiments, cross member portion 16D and base portion 12D are fixedly attached to leg struts 50D,51D,52D.

Figure 26:
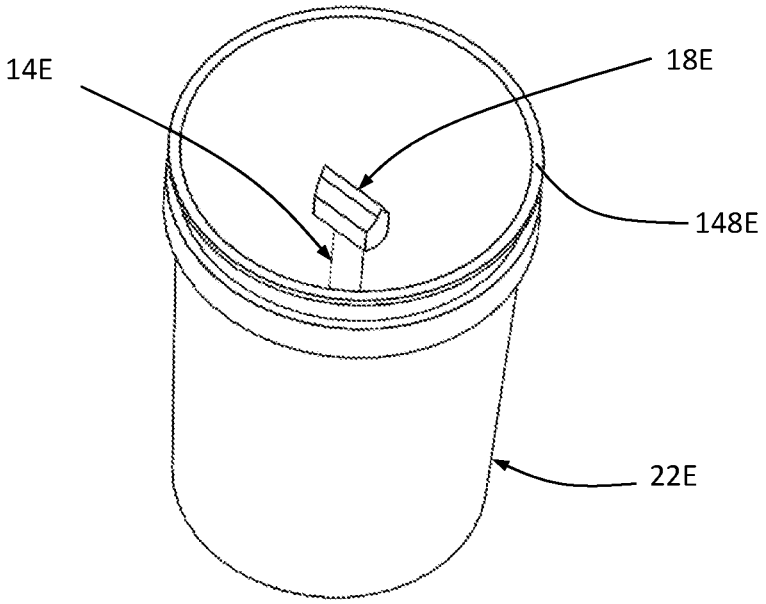
FIG. 26 is a perspective view of yet another embodiment of a kindling splitter whereby a blade portion extends through a center of a collector portion according to one or more embodiments shown and described herein.
Figure 27:
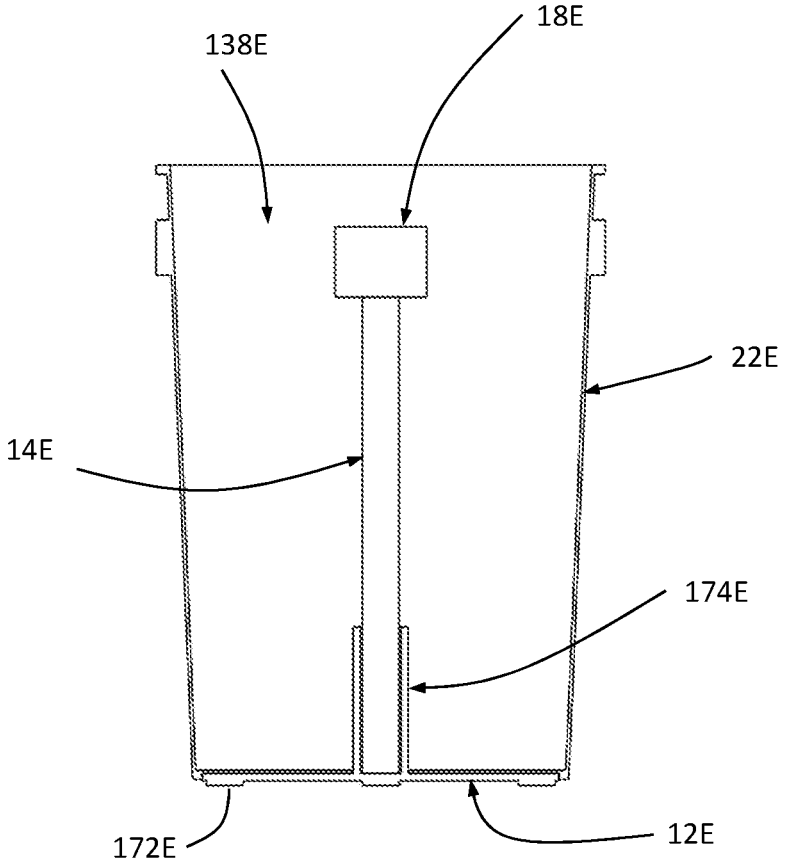
FIG. 27 is a cross-sectional view of the kindling splitter illustrated in FIG. 26 according to one or more embodiments shown and described herein.
Figure 28:
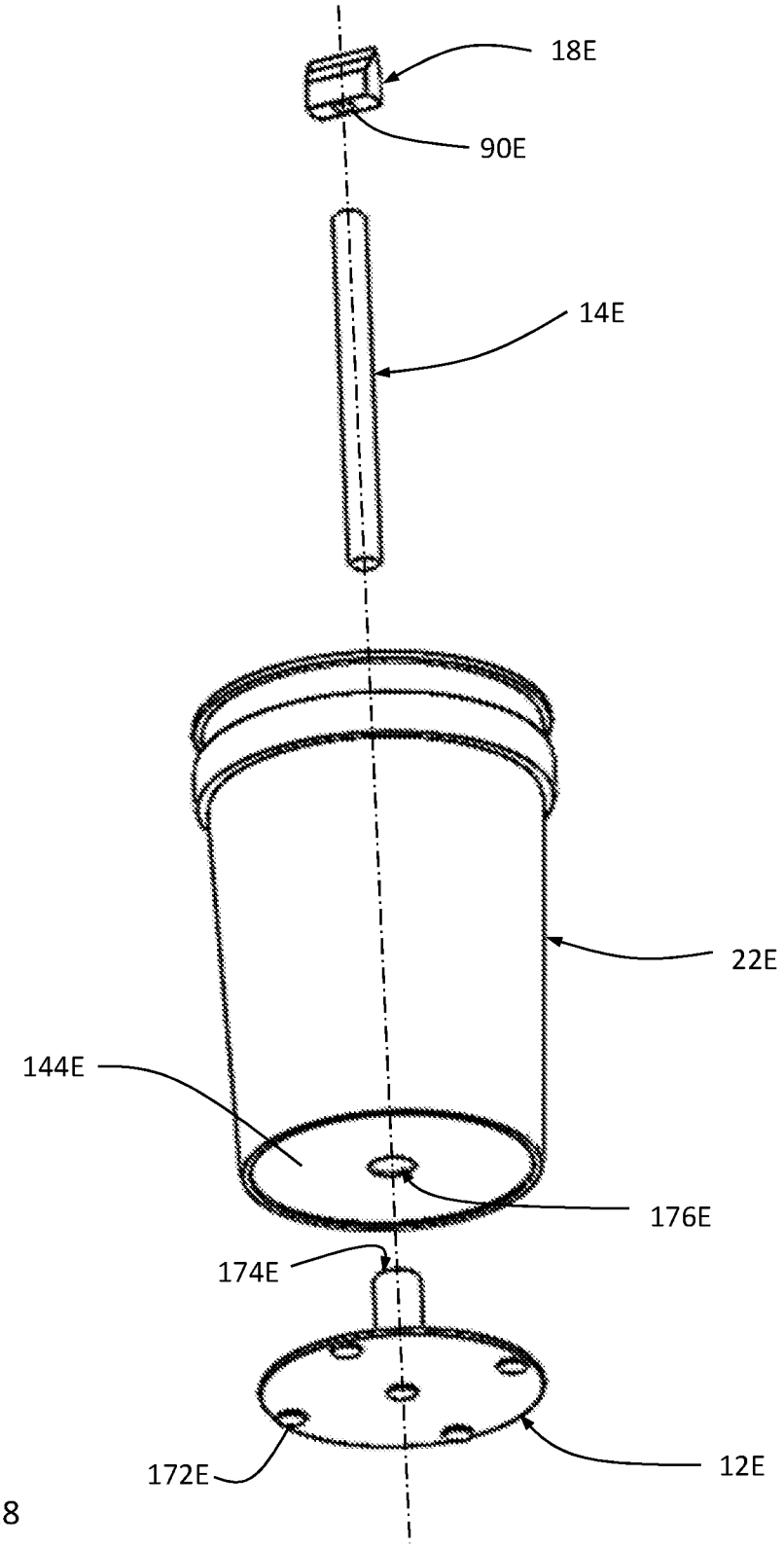
FIG. 28 is an exploded perspective view of the kindling splitter illustrated in FIG. 26 according to one or more embodiments shown and described herein.
Figure 29:
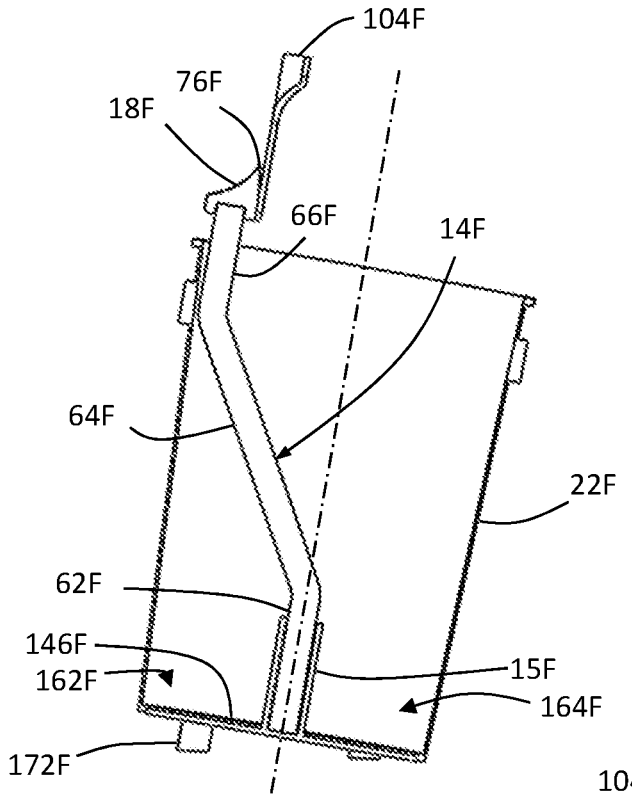
FIG. 29 is a cross-sectional view of another embodiment of kindling splitter whereby a leg portion is angled such that a blade portion is positioned near an edge of a collector portion according to one or more embodiments shown and described herein.

In yet another embodiment as illustrated in FIG. 26-28, an upwardly extending leg anchor 174E extends from a base portion 12E for releasable fixation of a splitter blade portion 18E. A collector aperture 176E formed within a floor of a collector portion 22E provides for passage of leg anchor 174E therethrough. In this embodiment, collector aperture 176E is centered in a floor 144E of collector portion 22E along a central axis of said collector portion 22E. In alternative embodiments, collector aperture 176E is non-centered wherein blade portion 18E is biased towards one side of collector portion 22E. Extending leg anchor 174E is in the form of a tube or a post sized to engage and releasably fix leg portion 14E upright. In alternative embodiments, leg anchor 174E is fixed to leg portion 14E. In this embodiment, base portion 12E is positioned inferior to floor 144E of collector portion 22E whereas in other forms wherein collector portion 22E is sufficiently strong to handle impact forces through floor 144E, base portion 12E may be positioned superior to floor 144E of collector portion 22E. Blade portion 18E is disposed on a superior end of leg portion 14E extending through capture space 138E of collector portion 22E. In some embodiments, blade portion 18E comprises an entry channel 90D sized for receiving leg portion 14E. In some embodiments, blade portion 18E resides at one of; a position below top face 148E of a collector portion, generally aligned with top face 148E, and a position above top face 148E of a collector portion 22E. In one embodiment, blade portion 18E has a guide portion extending from it such as illustrated with the embodiment in FIG. 42.

Figure 30:
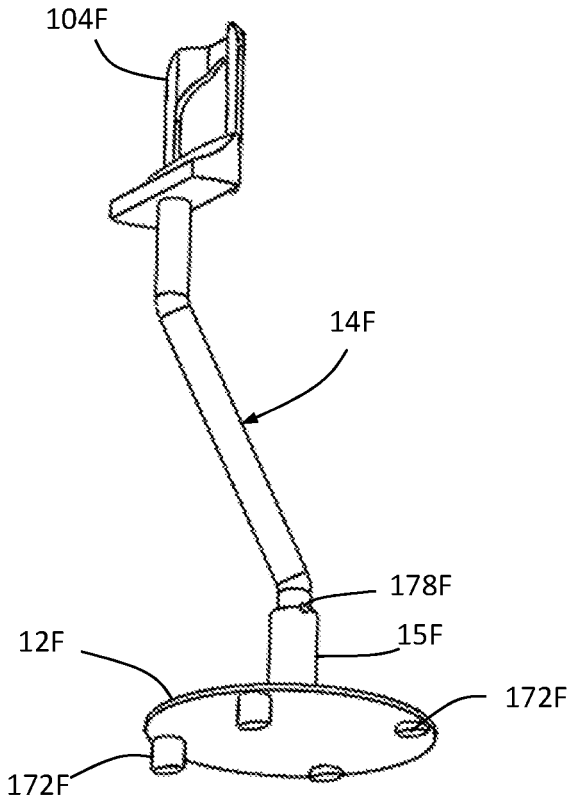
FIG. 30 is a perspective view of the kindling splitter of FIG. 29 with collector portion removed according to one or more embodiments shown and described herein.
Figure 31:
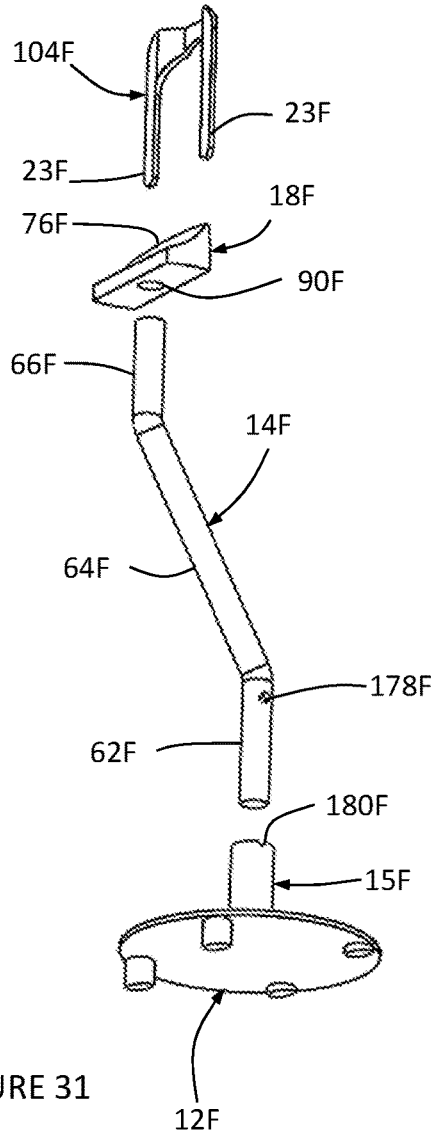
FIG. 31 is an exploded view of the kindling splitter of FIG. 29 with collector portion removed.
Figure 32:
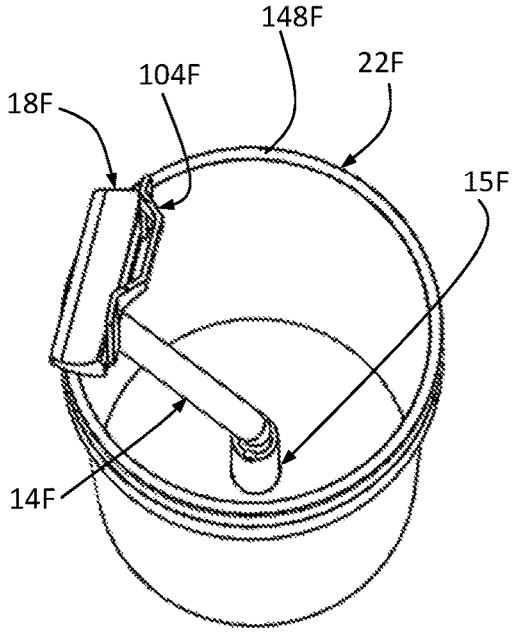
FIG. 32 is a top perspective view of the kindling splitter of FIG. 29 according to one or more embodiments shown and described herein.

In an alternative embodiment illustrated in FIGS. 29-32, leg portion 14F comprises one or more angled segments thereby positioning blade portion 18F adjacent a top face 148F of collector portion 22F. As illustrated in FIG. 31, leg portion 14F comprises a vertical segment 62F for engagement with leg anchor 15F, an angled segment 64F, and a guide segment 66F for engagement with blade portion 18F. In this embodiment, first leg positioner 178F (here in the form of a pin) on leg portion 14F engages second leg positioner 180F (here in the form of a notch) on leg anchor 15F to prevent rotational movement between a base portion 12F and a blade portion 18F when impacting a log against blade portion 18F. In preferred embodiments, blade portion 18F and leg portion 14F may be separated from base portion 12F for removal of collector portion 22F from base portion 12F.

As illustrated in FIG. 30, base portion 12F may comprise one or more base pods 172F of varying heights to cause an angulation of the base and as a consequence cause a central axis of collector portion 22F to be tilted thus causing a gravity assisted gathering of kindling on a low side 164F of collector portion 22F. In some embodiments, floor face 146F of collector portion 22F is angled with respect to horizontal again for the purpose of gravity assisted gathering.

Figure 33:
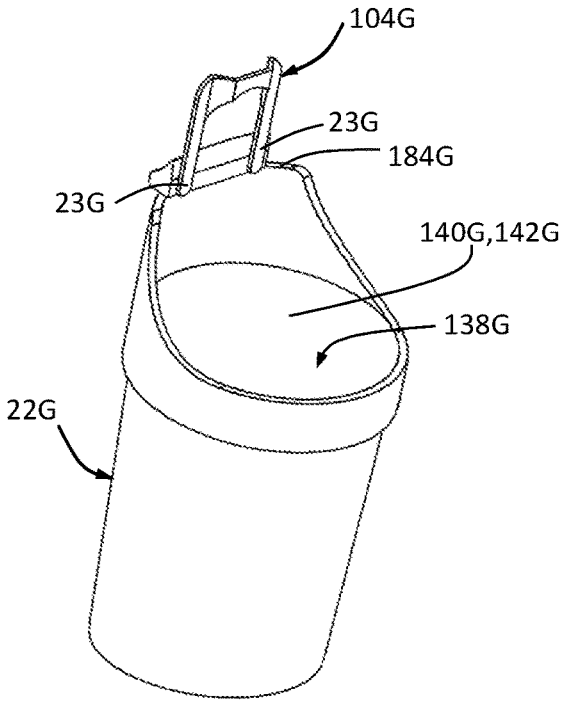
FIG. 33 is a perspective view of yet another embodiment of a kindling splitter whereby a blade portion is disposed on a superior aspect of a collector portion according to one or more embodiments shown and described herein.
Figure 34:
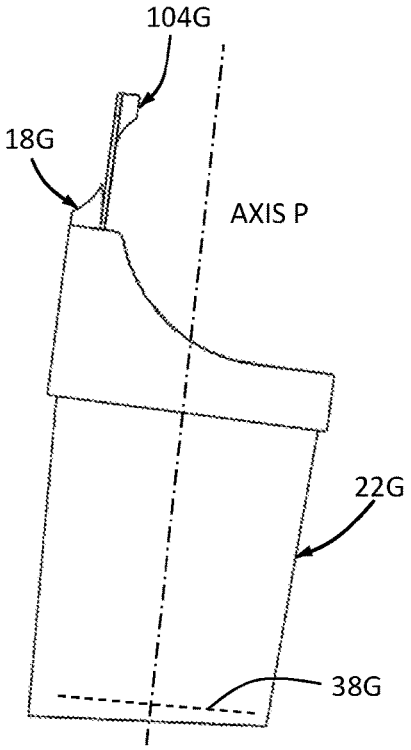
FIG. 34 is a side view of the kindling splitter of FIG. 33 according to one or more embodiments shown and described herein.

In yet another embodiment as illustrated in FIG. 33-34, a kindling splitter comprises a blade portion 18G mounted directly on a superior face 184G of collector portion 22G which is sufficiently rigid to withstand impact forces. In this embodiment, collector portion 22G may include a central axis (axis P) that is angled from vertical wherein impact to blade portion 18G reduces tipping. Here the kindling splitter comprises a collector portion 22G having a central axis angled from vertical and may include a floor 38G sloping away from said blade portion 18G.

Figure 35:
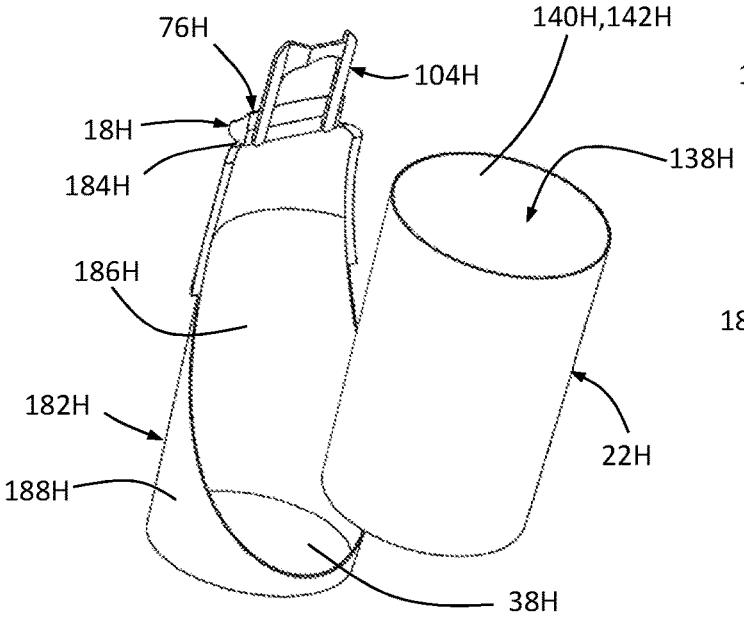
FIG. 35 is a perspective view of yet another embodiment of a kindling splitter whereby a collector portion is removably seated in a collector housing according to one or more embodiments shown and described herein.
Figure 36:
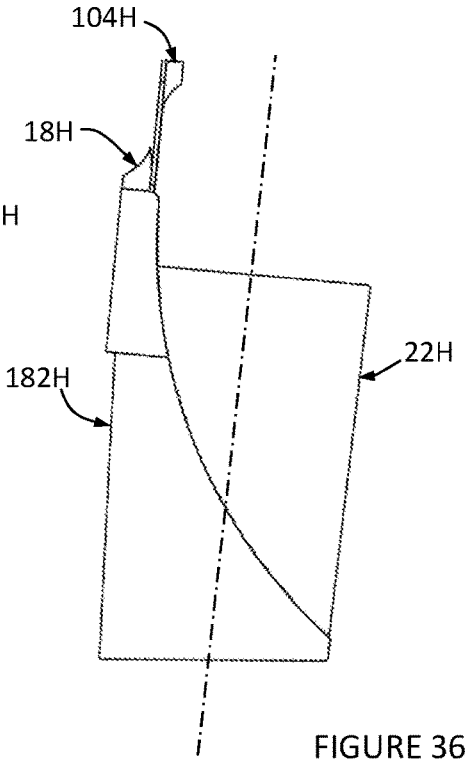
FIG. 36 is a side view of the kindling splitter illustrated in FIG. 35 with collector portion seated in a collector housing according to one or more embodiments shown and described herein.
Figure 37:
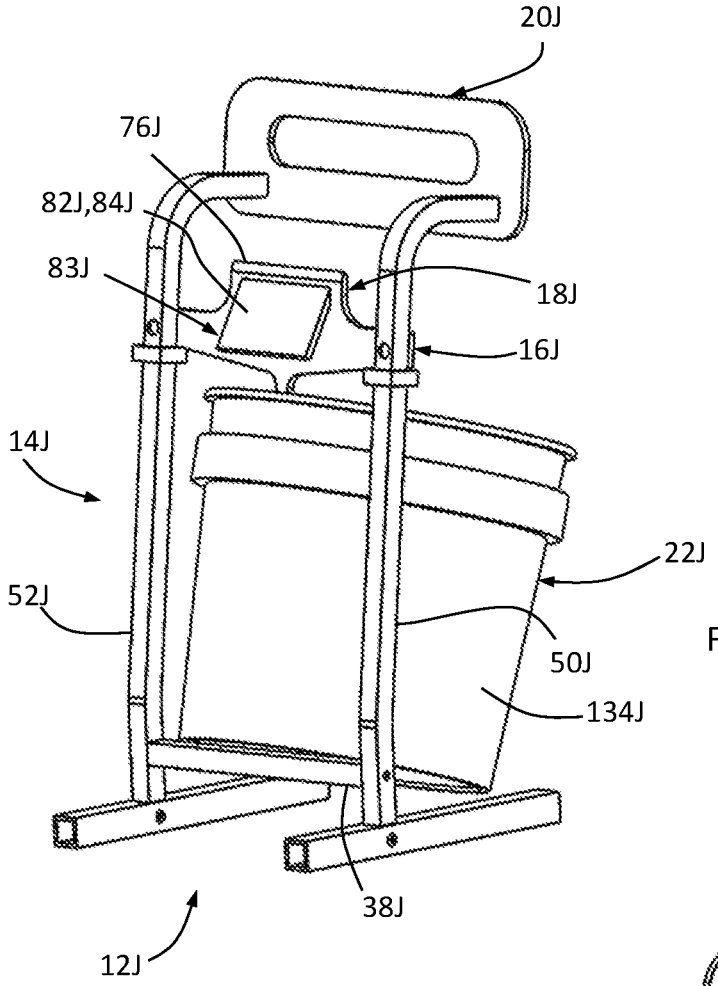
FIG. 37 is a rear perspective view of a kindling splitter according to one or more embodiments shown and described herein.
Figure 38:
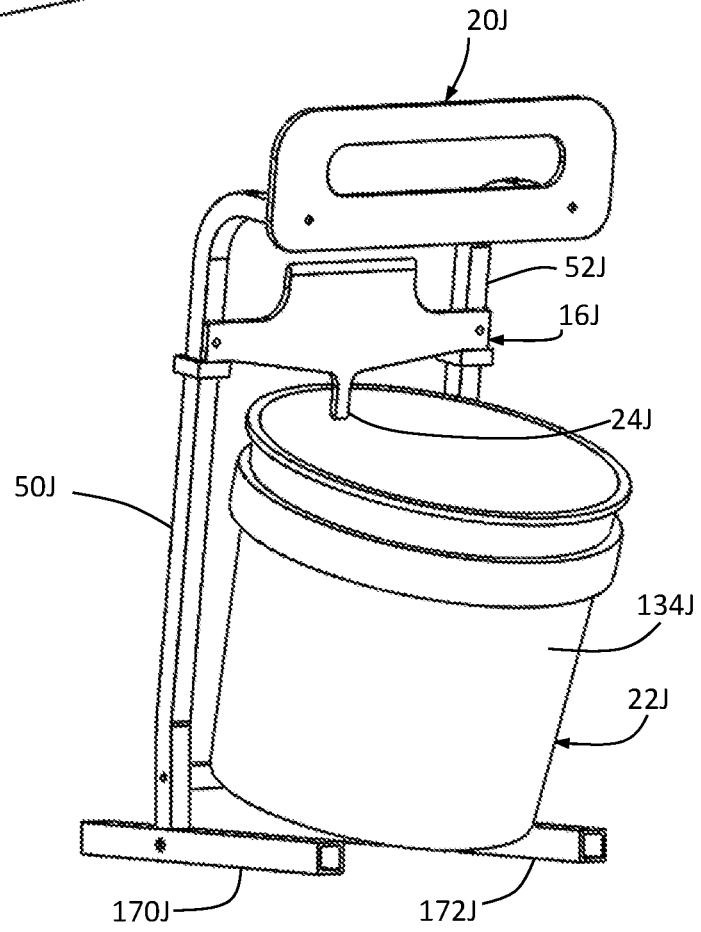
FIG. 38 is a front perspective view of the kindling splitter of FIG. 37 according to one or more embodiments shown and described herein.
Figure 39:
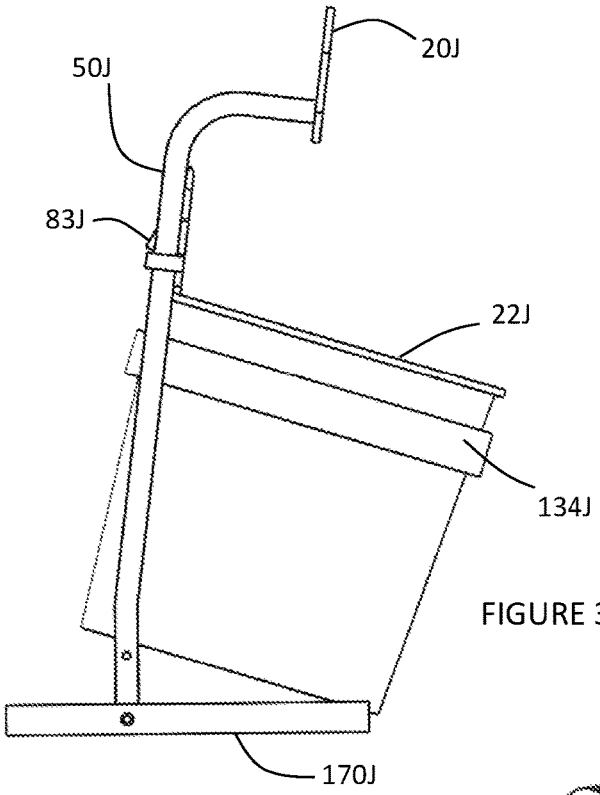
FIG. 39 is a side view of the embodiment illustrated in FIG. 37 according to one or more embodiments shown and described herein.

In an alternative embodiment illustrated in FIG. 35-36, a kindling splitter comprises a collector housing 182H having a blade portion mounted at a superior aspect (superior face 184H) thereof and sized for removable seating of a collector portion 22H therein said collector housing 182H. All collector portions in the various embodiments may include a bucket handle such as illustrated in FIG. 1.

FIG. 37-40 illustrates yet another embodiment of a kindling splitter in accordance with this disclosure. In this embodiment, leg portion 14J comprises a first leg strut 50J and a second leg strut 52J manufactured from a tubing having a generally square profile. First leg strut 50J and second leg strut 52J are secured at distal ends of lift 38J which in this embodiment functions both to space and secure the leg struts but also to serve as a prop for one end of collector portion 22J.

In this embodiment, cross member portion 16J is formed in unison with a blade portion 18J with a leading upward edge 76J for wood splitting. A second splitter plate 83J is fixed at an angle to blade portion 18J using welds. Second splitter wall 82J with second splitter surface 84J is formed on second splitter plate 83J to serve as a wedge during a splitting action. Collector retainer portion 24J in this embodiment is also formed in unison with cross member portion 16J and extends distal from cross member portion 16J. Leg portion 14J remains a main structural component of the system comprising first and second leg struts. First leg strut 50J is fixed at an inferior end to first base leg 170J and second leg strut 52J is fixed at an inferior end to second base leg 172J. Welds, fasteners such screws and nuts may be used for fixation. In one form, one or more threaded nuts are welded to an inside wall of a tube for threaded engagement with a fastener. In other forms, barrel nuts with fasteners may be used to secure assembly.

In this embodiment, a first lock collar encircles a first leg strut 50J and a second lock collar encircles a second leg strut 52J and with each welded in place on the respective first and second leg strut. A superior aspect of each lock collar serves as a rigid step on which cross member portion 16J rests and counteracts impact forces during splitting. In addition, fasteners are used through screw apertures 128J on leg struts to secure guide portion 20J to said first leg strut 50J and second leg strut 52J engaging threaded apertures 56J in cross member portion 16J.

Figure 41:
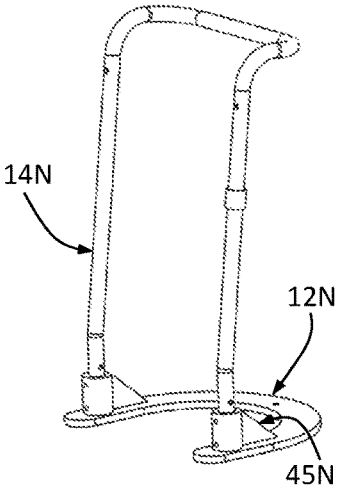
FIG. 41 is a perspective view of the use of one or more gussets between a base portion and a leg portion according to one or more embodiments shown and described herein.
Figure 40:
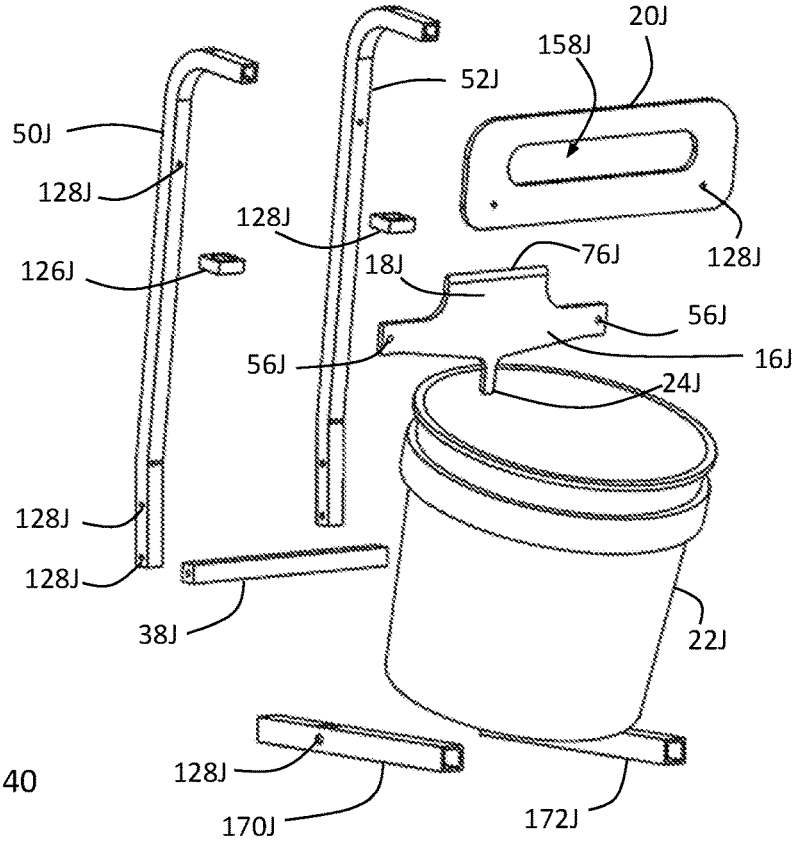
FIG. 40 is a partial exploded view of the splitter with fasteners removed of the splitter illustrated in FIG. 37 according to one or more embodiments shown and described herein.

FIG. 41 illustrates an alternative embodiment demonstrating the use of a gusset 20N to provide rigid support between a base portion 12N and a leg portion 14N for the purpose of strengthening the system and reducing loading bounce during splitting.

Figure 42:
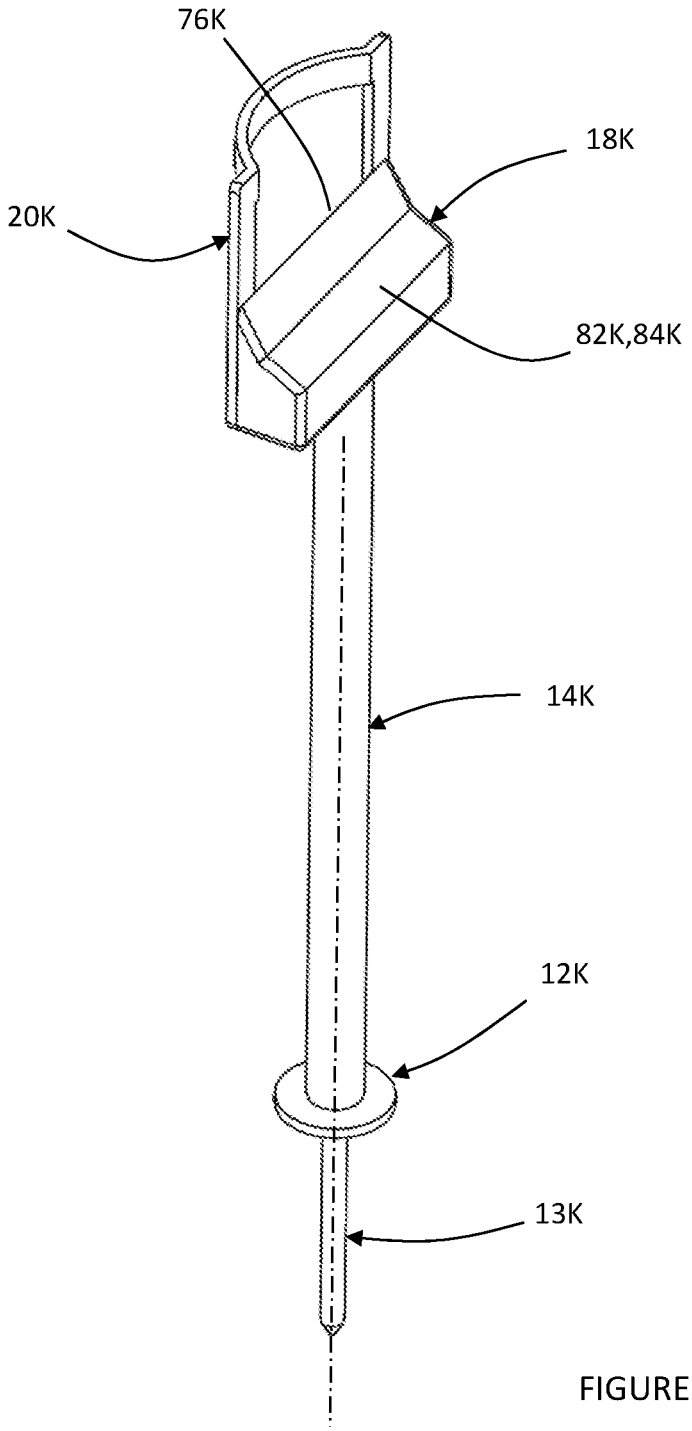
FIG. 42 is a perspective view of one embodiment of a kindling splitter configured for staking into the ground for stability by a stake portion extending from a base portion according to one or more embodiments shown and described herein.

FIG. 42 illustrates yet another embodiment of a kindling splitter comprising a blade portion 18K comprising a leading upward edge 76K. A guide portion 20K is secured to blade portion 18K for guidance of wood towards blade portion 18K. Guide portion 20K, here shown in the shape of an inverted U, may be used as a handle a user grasps to transport the device. Leg portion 14K is in the form of an elongate bar or tube. A blade end of leg portion 14K is housed in a complementary receiving port on inferior side of blade portion 18K. Alternatively, complementing surfaces between the receiving port and blade portion may be threaded, however in yet other embodiments welds may be used. In one embodiment a receiving port is absent and the leg portion 14K is welded directly to blade portion 18K. Base portion 12K spreads laterally from leg portion 14K to provide lateral support to leg portion 14K against ground and to serve as a stop when driving stake portion 13K into ground where it serves as support to keep blade portion 18K upright. Base portion 12K may also be used as an impact surface to drive stake portion 13K into the ground. In one embodiment, an outer impact sleeve encircles leg portion 14K wherein a user may grasp an outer surface of the outer impact sleeve and forcibly slide it along leg portion 14K to pound stake portion 13K into the ground. Stake portion 13K may assume a variety of forms including for example, one or more elongate rods, a tube, and a blade. Stake portion 13K may be pointed at an inferior point. Stake portion 13K in this embodiment is welded to leg portion 14K however may be formed using one or more alternative methods such as threads and friction fit and machined as an extension of leg portion 14K. In some forms stake portion 13K may be finned. In some embodiments stake portion 13K is in the form of a helically coiled rod that is rotated into the ground.

Figure 43:
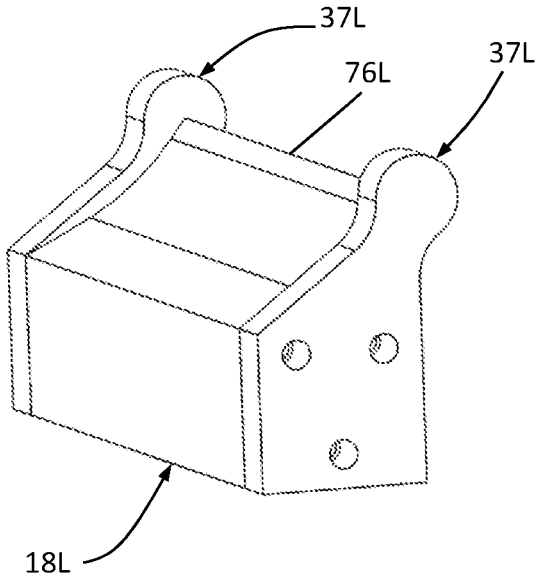
FIG. 43 is a perspective view of one embodiment of a blade portion having blade guards at each end of a leading upward edge of a blade according to one or more embodiments shown and described herein.
Figure 43B:
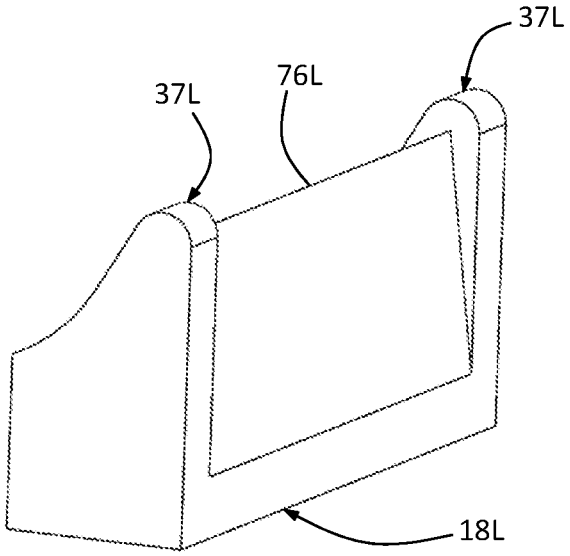
FIG. 43B is a perspective view of another embodiment of a blade portion having blade guards 37L integrated into a blade portion according to one or more embodiments shown and described herein.

FIGS. 43 and 43B illustrate embodiments of a blade portion 18L having one or more blade guards 37L extending above a leading upward edge 76L at opposed ends of leading upward edge 76L. As illustrated in FIG. 43, blade guard 37L is in the form of a plate fastened or welded to opposed ends of leading upward edge 76L and having an oversized boss near edge 76L. As illustrated in FIG. 43B, blade guard 37L is again in the form of an oversized boss integral with blade portion 18L. A blade guard 37L functions as an optional safety feature to prevent an elongate cut should a user unintentionally fall on the blade.

Figure 44:
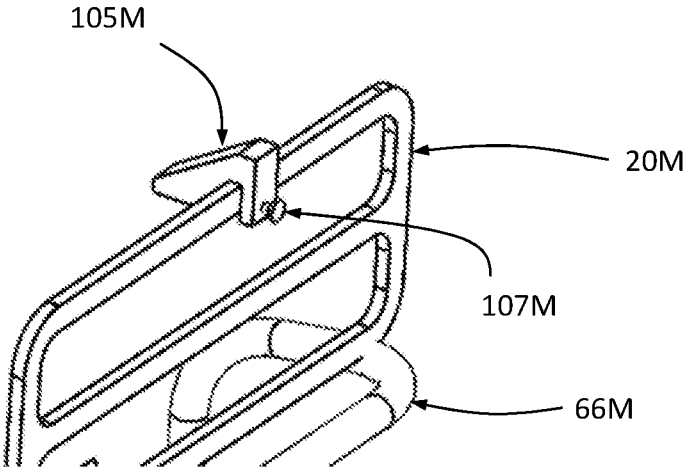
FIG. 44 is a partial perspective view of a guide portion of a kindling splitter having an adjustable secondary guide according to one or more embodiments shown and described herein.

FIG. 44 illustrates one embodiment of a secondary guide 105M that cooperates with guide portion 20M to guide wood, logs or other splitting material along a secondary path such as a plane. In this embodiment, secondary guide 105M is positioned generally perpendicular to guide portion 20M and adjustably slides along one edge. Here, secondary guide may comprise a guide lock illustrated here in the form of a locking screw 107M for locking secondary guide 105M in a predetermined position relative to a guide portion 20M. In embodiments having a secondary blade, secondary guide 105M may be used to repeatedly position wood over a preferred location above the blades for most effective splitting.

In one embodiment, a method for using a wood splitter 10 comprises the step of placing a splitter frame 11 on a sturdy support surface. A collector portion 22 which may be in the form of a handled bucket 130 is placed under a blade portion 18 and positioned on a lift 38 causing a floor face 146 of the collector portion 22 to be sloped. If so desired, the distance between a guide spacer 114 or guide plate 104 is adjusted to produce a kindling piece of a predetermined thickness. Placing a log end on top a leading upward edge 76 of an angled blade portion 18 with the side of the log 58 resting against a glide face 116 of a guide spacer 114 or guide face 116 of a guide plate 104. Stabilizing the log 58 with one hand on a lateral wall of the log away from the blade portion 18. Impacting a superior end of the log using a mass such as a mallet to cause the log 58 to be split over the blade portion 18 causing a main portion of the log 58 to slide down a second splitter surface 84 and a kindling 60 piece to slide down a first splitter surface 80 of the blade portion 18 towards the high side 162 of a collector portion 22. A distal end of the kindling drops to a high side 162 of a floor face 146 of a collector and slides, falls or slides and falls to the low side 164 of the collector where the kindling 60 are gathered with the assistance of gravity. Collector portion 22 and newly split kindling 60 are removed from a splitter frame 11 using a bucket handle 132 if so desired and relocating for consumption.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A wood splitter apparatus in an operational configuration comprising:

a base portion operable to impart stability of the wood splitter over a support surface;

a leg portion extending upwards from said base portion;

said leg portion comprising a first leg strut spaced from a second leg strut;

an elevated cross member portion extending from said first leg strut to said second leg strut;

a blade portion extending superiorly from said cross member portion;

a leading upward edge at a superior aspect of said blade portion for splitting wood;

a first splitter surface angled from a second splitter surface inferior to said leading upward edge;

a collector portion positioned below said blade portion;

said collector portion having an exterior;

said collector portion having a capture space;

said collector portion having a floor face at a bottom of said capture space;

said exterior of said collector portion positioned adjacent said leg portion;

said floor face of said collector portion positioned superior to said base portion;

a high side of said floor face of said collector portion positioned directly under said blade portion;

whereas kindling split from a log over said blade portion falls into a high side of said floor face and gathers on a low side of said floor face.

2. The wood splitter apparatus of claim 1 further comprising:

an inside surface of said collector portion; and a collector retainer portion extending inferiorly from said cross member portion operable to abut against said inside surface of said collector portion to retain position of said collector portion.

3. The wood splitter apparatus of claim 1 further comprising a lift positioned above said base operable to lift one end of said collector portion thereby creating a high side of said floor face.

4. The wood splitter apparatus of claim 1 further comprising a guide portion spaced from said blade portion sufficient to pass a split piece of kindling wood therebetween.

5. The wood splitter apparatus of claim 1 wherein at least one of said base portion and said cross member portion is fastened to said leg portion using one or more fasteners.

6. The wood splitter apparatus of claim 1 wherein a portion of said collector portion rests between said first leg strut and said second leg strut.

7. The wood splitter of claim 1 whereas at least a portion of the leg portion is angled from vertical as said leg portion extends superiorly from said base portion.

8. A wood splitter apparatus comprising:

a base portion operable to impart stability to said wood splitter over a support surface;

a leg portion extending upwards from said base portion;

said leg portion comprising a first leg strut spaced from a second leg strut and whereas at least a portion of the leg portion is angled from vertical as said leg portion extends superiorly from said base portion;

a lift positioned above said base portion operable to elevate one side of a collector portion positioned on said lift and over said base thereby establishing a high side of a floor face of the collector portion and a low side of the floor face of the collector portion when said wood splitter is in an operable configuration;

an elevated cross member portion extending from said first leg strut to said second leg strut;

a blade portion angled from vertical extending superiorly from said cross member portion;

a leading upward edge at a superior aspect of said blade portion for splitting wood; and said blade portion comprising a first splitter surface angled from a second splitter surface inferior to said leading upward edge.

9. The wood splitter apparatus of claim 8 further comprising:

a collector portion positioned below said blade portion; and said collector portion having a capture space for collecting kindling therein.

10. The wood splitter apparatus of claim 9 further comprising;

said collector portion having a floor face at a bottom of said capture space; and said collector portion supported at an angle such that said floor face is sloped defining a high side and a low side of said capture space as defined by said angled floor face.

11. The wood splitter apparatus of claim 9 wherein said collector portion is a five gallon bucket.

12. The wood splitter apparatus of claim 9 wherein said collector portion comprises a handle.

13. The wood splitter apparatus of claim 8 further comprising; a lift positioned above said base portion operable to angle a collector portion to have a non-vertical central axis in an operable configuration.

14. The wood splitter apparatus of claim 8 further comprising a guide portion spaced from the blade portion sufficient to pass a split piece of kindling wood therebetween.

15. The wood splitter apparatus of claim 9 wherein said cross member portion comprises a collector retainer portion extending inferiorly from said cross member portion for restraining said collector at an angle.

16. The wood splitter apparatus of claim 8 wherein at least one of said base portion and said cross member portion is fastened to said leg portion using one or more fasteners.

17. The wood splitter apparatus of claim 8 further comprising a second splitter plate fixed at an angle to said blade portion by a weld.

18. The wood splitter apparatus of claim 8 further comprising a gusset extending between said base portion and said leg portion.

19. The wood splitter apparatus of claim 8 further comprising a collector portion wherein a portion of said collector portion rests between said first leg strut and said second leg strut.

20. The wood splitter of claim 8 wherein said blade portion is removable from said cross member portion.

* * * * *